US011215946B2

(12) United States Patent
Koyama et al.

(10) Patent No.: US 11,215,946 B2
(45) Date of Patent: Jan. 4, 2022

(54) SHEET PROCESSING APPARATUS AND IMAGE FORMING SYSTEM

(71) Applicant: CANON KABUSHIKI KAISHA, Tokyo (JP)

(72) Inventors: Tomooku Koyama, Suntou-gun (JP); Jun Agata, Suntou-gun (JP); Yasuhiro Nakahara, Kawasaki (JP); Hiroharu Tsuji, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 43 days.

(21) Appl. No.: 16/890,085

(22) Filed: Jun. 2, 2020

(65) Prior Publication Data

US 2020/0387101 A1 Dec. 10, 2020

(30) Foreign Application Priority Data

Jun. 7, 2019 (JP) ..... JP2019-107294
Mar. 18, 2020 (JP) ..... JP2020-047782

(51) Int. Cl.
*G03G 15/00* (2006.01)
*B65H 37/04* (2006.01)
(Continued)

(52) U.S. Cl.
CPC ..... *G03G 15/6544* (2013.01); *B65H 9/004* (2013.01); *B65H 31/02* (2013.01); *B65H 31/3027* (2013.01); *B65H 37/04* (2013.01); *G03G 15/6552* (2013.01); *G03G 15/6573* (2013.01); *B65H 2301/421* (2013.01); *B65H 2701/131* (2013.01); *B65H 2801/27* (2013.01); *G03G 2215/00421* (2013.01);
(Continued)

(58) Field of Classification Search
CPC combination set(s) only.
See application file for complete search history.

(56) References Cited

U.S. PATENT DOCUMENTS 7,697,883 B2 4/2010 Ogata et al.
7,850,161 B2 * 12/2010 Fukatsu ..... G03G 15/6538 270/58.12
(Continued)

FOREIGN PATENT DOCUMENTS

JP 02158561 A * 6/1990 ..... B42C 1/12
JP 07237808 A * 9/1995
(Continued)

*Primary Examiner* — Jennifer Bahls
(74) *Attorney, Agent, or Firm* — Venable LLP

(57) ABSTRACT

A sheet processing apparatus includes a conveyance unit configured to convey a sheet, a stacking portion on which the sheet conveyed by the conveyance unit is stacked, a first regulation member configured to regulate a position of an edge portion, in a conveyance direction, of the sheet stacked on the stacking portion, a second regulation member configured to regulate a position of an edge portion, in a width direction orthogonal to the conveyance direction, of the sheet stacked on the stacking portion, a binding unit supported movably in the conveyance direction and configured to perform a binding process of binding the sheet stacked on the stacking portion, and a moving unit configured to move the second regulation member in the conveyance direction accompanied with a movement, in the conveyance direction, of the binding unit.

20 Claims, 15 Drawing Sheets

(51) Int. Cl.
*B65H 9/00* (2006.01)
*B65H 31/30* (2006.01)
*B65H 31/02* (2006.01)

(52) U.S. Cl.
CPC ..... *G03G 2215/00679* (2013.01); *G03G 2215/00827* (2013.01); *G03G 2215/00848* (2013.01); *G03G 2221/1657* (2013.01)

(56) References Cited

U.S. PATENT DOCUMENTS

| | | | | |
|---|---|---|---|---|
| 7,963,523 | B2 | 6/2011 | Koshimura et al. | |
| 8,170,463 | B2 | 5/2012 | Ogata et al. | |
| 8,342,499 | B2 | 1/2013 | Shiraishi et al. | |
| 8,360,421 | B2 | 1/2013 | Tsuji et al. | |
| 9,309,075 | B2 | 4/2016 | Ochi et al. | |
| 2011/0233844 | A1* | 9/2011 | Shiraishi ..... | B42B 5/00 270/58.11 |
| 2019/0193979 | A1 | 6/2019 | Hatakeyama et al. | |
| 2020/0062529 | A1 | 2/2020 | Tsuji | |

FOREIGN PATENT DOCUMENTS

| | | | | |
|---|---|---|---|---|
| JP | H09-235071 | A | 9/1997 | |
| JP | 2000-289921 | A | 10/2000 | |
| JP | 2011-207560 | A | 10/2011 | |
| JP | 2015-063387 | A | 4/2015 | |
| WO | WO-2007013526 | A1 * | 2/2007 | ..... B65H 31/34 |

* cited by examiner

SHEET PROCESSING APPARATUS AND IMAGE FORMING SYSTEM

BACKGROUND OF THE INVENTION

Field of the Invention

The present invention relates to a sheet processing apparatus which processes a sheet and an image forming system which forms an image on the sheet.

Description of the Related Art

As an option for an image forming apparatus, for example, an electrophotographic type composite machine, a sheet processing apparatus is used to perform a binding process and sorting process to a sheet with an image formed by the image forming apparatus. Japanese Patent Laid-Open No. 2011-207560 describes the sheet processing apparatus which aligns a sheet bundle stacked on a compiling purpose stacking portion by a side guide and a tamper and thereafter staples the aligned sheet bundled by a stapler or a needleless binding apparatus. The stapler and the needleless binding apparatus are movably supported by a stapler rail and a needleless binding apparatus rail, respectively, and are able to move to an edge and a corner portion of the sheet bundle.

Japanese Patent Laid-Open No. 2015-63387 describes a postprocessing apparatus which includes a stacker unit to stack the sheet bundle, performs the binding process of binding the sheet bundle by a saddle stitching stapler, and is able to perform a folding process to the sheet bundle by a folding roller unit. In the stacker unit, a front edge regulation member is provided to regulate a position of a downstream edge portion of the sheet bundle in a sheet conveyance direction, and the front edge regulation member is supported movable in the sheet conveyance direction depending on a size of the sheet. Further, a position of the sheet bundle stacked on the stacking unit in a width direction is aligned by a sheet side edge aligning member.

However, since it is unable to dispose the side guide and the tamper described in Japanese Patent Laid-Open No. 2011-207560 within a moving range of the stapler or the needleless binding apparatus, there were cases where alignment of the sheet was not performed well. Further, since it is also unable to dispose the sheet side edge aligning member described in Japanese Patent Laid-Open No. 2015-63387 within a moving range of the front edge regulation member, there were cases where the alignment of the sheet was not performed well.

SUMMARY OF THE INVENTION

According to a first aspect of the present invention, a sheet processing apparatus includes a conveyance unit configured to convey a sheet, a stacking portion on which the sheet conveyed by the conveyance unit is stacked, a first regulation member configured to regulate a position of an edge portion, in a conveyance direction, of the sheet stacked on the stacking portion, a second regulation member configured to regulate a position of an edge portion, in a width direction orthogonal to the conveyance direction, of the sheet stacked on the stacking portion, a binding unit supported movably in the conveyance direction and configured to perform a binding process of binding the sheet stacked on the stacking portion, and a moving unit configured to move the second regulation member in the conveyance direction accompanied with a movement, in the conveyance direction, of the binding unit.

According to a second aspect of the present invention, a sheet processing apparatus includes a conveyance unit configured to convey a sheet, a stacking portion on which the sheet conveyed by the conveyance unit is stacked, a first regulation member configured to regulate a position of an edge portion, in a conveyance direction, of the sheet stacked on the stacking portion, a second regulation member configured to regulate a position of an edge portion, in a width direction orthogonal to the conveyance direction, of the sheet stacked on the stacking portion, and a binding unit supported movably in the conveyance direction and configured to perform a binding process of binding the sheet stacked on the stacking portion, wherein the binding unit is disposed not to overlap with the second regulation member when viewed in the conveyance direction.

Further features of the present invention will become apparent from the following description of exemplary embodiments with reference to the attached drawings.

DESCRIPTION OF THE EMBODIMENTS

Figure 1:
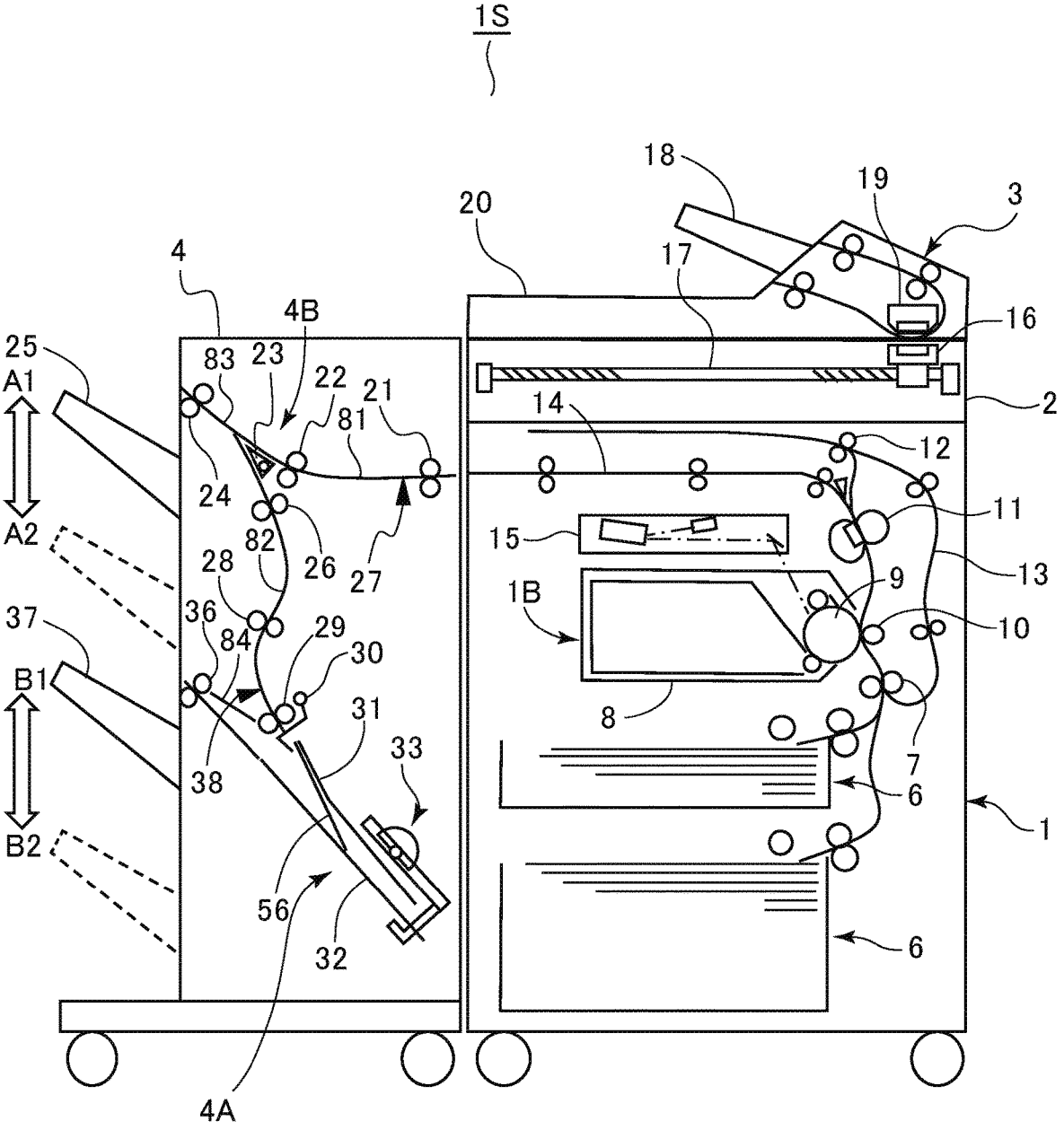
FIG. 1 is a schematic diagram showing a general configuration of an image forming system according to a first embodiment of the present invention.

Hereinafter, exemplary embodiments of the present invention will be described with reference to the accompanying drawings.

First Embodiment

General Configuration

An image forming system 15 according to a first embodiment is configured with an image forming apparatus 1, an image reading apparatus 2, a document feeding apparatus 3, and a postprocessing apparatus 4. The image forming system 15 forms an image on a sheet, which is a recording material, and outputs the sheet after performing a processing of the sheet by the postprocessing apparatus 4, if required. Hereinafter, a movement of each apparatus will be described simply, and thereafter the postprocessing apparatus 4 will be described in detail.

The document feeding apparatus 3 transports a document placed on a document tray 18 to image reading units 16 and 19. Each of the image reading units 16 and 19 is an image sensor to read image information from a surface of the document, and image information is read from both sides by once conveyed the document. The document having been read of the image information is discharged to a document discharge portion 20. Further, by reciprocally moving the image reading unit 16 by a driving device 17, the image reading apparatus 2 is able to read the image information from a stationary document put on a platen glass (including a document for which the document feeding apparatus 3 is unusable, such as a booklet document).

The image forming apparatus 1 is an electrophotographic apparatus furnished with an image forming unit 1B of a direct transfer system. The image forming unit 1B includes a cartridge 8 having a photosensitive drum 9, and a laser scanner unit 15 disposed above the cartridge 8. To perform an image formation, a surface of the rotating photosensitive drum 9 is charged, and the laser scanner unit 15 bears an electrostatic latent image on the surface of the photosensitive drum 9 by exposing the photosensitive drum 9 based on the image information. The electrostatic latent image born on the photosensitive drum 9 is developed with a charged toner particle to a toner image, and the toner image is transferred to a transfer portion at which the photosensitive drum 9 and a transfer roller 10 are facing each other. A controller of the image forming apparatus 1 performs an image forming processing of the image forming unit 1B based on the image information read by the image reading units 16 and 19 or image information received from an external computer via a network.

The image forming apparatus 1 includes a plurality of feeding units 6 which feed the sheet, the recording material, one by one at a predetermined interval. After corrected a sheet skew at a pair of registration rollers 7, the sheet fed from the plurality of the feeding units 6 is conveyed to the transfer portion, and transferred by the toner image born on the photosensitive drum 9 at the transfer portion. A fixing unit 11 is disposed downstream of the transfer portion in a sheet conveyance direction. The fixing unit 11 includes a pair of rotary members to convey the sheet in a sandwiched manner and a heating member, such as a halogen lamp, to heat the toner image, and performs a development process of an image by heating and pressing the toner image on the sheet.

In a case where the sheet having been formed of the image is discharged outside the image forming apparatus 1, the sheet which has passed the fixing unit 11 is conveyed to the postprocessing apparatus 4 via a horizontal conveyance portion 14. In a case of the sheet on which the image of a first surface of double-sided printing has been formed, the sheet which has passed the fixing unit 11 is delivered to a pair of reverse conveyance rollers 12, and is conveyed in a switchback conveyance manner by the pair of the reverse conveyance rollers 12 to the pair of the registration rollers 7 again via a reconveyance portion 13. Then, by passing the transfer portion and fixing unit 11 again, the sheet is formed of the image on a second surface of the sheet, and is conveyed to the postprocessing apparatus 4 via the horizontal conveyance portion 14.

The image forming unit 1B described above is an example of the image forming unit, an electrophotographic unit of an intermediate transfer system which transfers the toner image born on a photosensitive member to the sheet via an intermediate transfer member is also acceptable. Further, it is also acceptable to use an ink jet system and an offset printing system as the image forming unit.

Postprocessing Apparatus

The postprocessing apparatus 4 includes a binding process unit 4A to perform a binding process to the sheet, and discharges a sheet bundle after performing the binding process to the sheet received from the image forming apparatus 1. Further, the postprocessing apparatus 4 is capable of discharging the sheet received from the image forming apparatus 1 without performing the binding process.

The postprocessing apparatus 4 includes, a receiving path 81, an inner discharge path 82, a first discharge path 83, and a second discharge path 84, as conveyance paths on which the sheet is conveyed, and includes an upper sheet discharge tray 25 and a lower sheet discharge tray 37, as discharge destinations to which the sheet is discharged. The receiving path 81, as a first conveyance path, is the conveyance path on which the sheet received from the image forming apparatus 1 is conveyed, and the inner discharge path 82, as a second conveyance path, is the conveyance path which extends below the receiving path 81 and guides the sheet toward the binding process unit 4A. The first discharge path 83 is the conveyance path to discharge the sheet to the upper sheet discharge tray 25, and the second discharge path 84, as a third conveyance path, is the conveyance path extending along a sheet discharge direction CD, described later, and guiding the sheet toward the lower sheet discharge tray 37.

The sheet discharged from the horizontal conveyance portion 14 of the image forming apparatus 1 is received by a pair of inlet rollers 21, and conveyed to a pair of pre-reverse conveyance rollers 22 passing through the receiving path 81. An inlet sensor 27 detects the sheet at a detection position disposed between the pair of the inlet rollers 21 and the pair of the pre-reverse conveyance rollers 22. The pair of the pre-reverse conveyance rollers 22 conveys the sheet received from the pair of the inlet rollers 21 toward the first discharge path 83.

To be noted, at a predetermined timing after detection of a passage of a trailing edge of the sheet by the inlet sensor 27, the pair of the pre-reverse conveyance rollers 22 accelerate a sheet conveyance speed to faster than the sheet conveyance speed at the horizontal conveyance portion 14. On the other hand, it is acceptable to set the sheet conveyance speed of the pair of the inlet rollers 21 larger than the sheet conveyance speed at the horizontal conveyance portion 14 and accelerate the sheet conveyance speed at the pair of the inlet rollers 21 which is disposed upstream of the pair of the pre-reverse conveyance rollers 22. In this case, it is preferred to provide a one way clutch(es) between a plurality of conveyance rollers at the horizontal conveyance portion 14 and a driving motor(s) of the plurality of the conveyance rollers, and configure the plurality of the conveyance rollers to rotate idly in a case where the sheet is pulled by the pair of the inlet rollers 21.

In a case where the sheet is discharged to the upper sheet discharge tray 25, a pair of reverse conveyance rollers 24 discharge the sheet received from the pair of the pre-reverse conveyance rollers 22 to the upper sheet discharge tray 25. In this case, the pair of the reverse conveyance rollers 24 reduce the sheet conveyance speed to a predetermined discharge speed in a predetermined timing after the trailing edge of the sheet has passed the pair of the pre-reverse conveyance rollers 22.

In a case where the sheet is discharged to the lower sheet discharge tray 37, the pair of the reverse conveyance rollers 24, as a reverse portion, performs switchback-conveyance of inverting the sheet received from the pair of the pre-reverse conveyance rollers 22 to the inner discharge path 82. A check valve 23 is arranged at a branch portion of the receiving path 81 and the inner discharge path 82 from the first discharge path 83. Incidentally, the branch portion is disposed upstream of the pair of the reverse conveyance rollers 24 in a sheet discharge direction of the pair of the reverse conveyance rollers 24. The check valve 23 has a function to regulate the sheet conveyed by the pair of the reverse conveyance rollers 24 in the switchback conveyance manner not to flow backward to the receiving path 81.

A pair of inner discharge rollers 26, a pair of intermediate conveyance rollers 28, and a pair of kick-out rollers 29 disposed on the inner discharge path 82 successively convey the sheet received from the pair of the reverse conveyance rollers 24 to a binding process unit 4A. A preceding intermediate stacker sensor 38 detects the sheet between the pair of the intermediate conveyance rollers 28 and the pair of the kick-out rollers 29. Regarding the inlet sensor 27 and the preceding intermediate stacker sensor 38, it is acceptable to use an optical sensor which detects presence and absence of the sheet at the detection position using light.

The binding process unit 4A includes a stapler 51 described later (refer to FIG. 2), and, having aligned a plurality of the sheets received from the inner discharge path 82, binds a predetermined position of a sheet bundle by the stapler 51. Detail configurations and movements of the binding process unit 4A will be described later. The sheet bundle bound by the binding process unit 4A is delivered to a pair of bundle discharge rollers 36 via the second discharge path 84, and discharged outside the apparatus by the pair of the bundle discharge rollers 36, as a discharge unit, and stacked on the lower sheet discharge tray 37.

Both of the upper sheet discharge tray 25 and the lower sheet discharge tray 37 are capable of ascending and descending with respect to a casing of the postprocessing apparatus 4. The postprocessing apparatus 4 includes sheet surface detection sensors to detect a position of an uppermost sheet (stacking height of the sheet) on the upper sheet discharge tray 25 and the lower sheet discharge tray 37, and, when one of the sheet surface detection sensors detects the sheet, a corresponding tray is descended toward a direction of A2 or B2 in FIG. 1. Further, when one of the sheet surface detection sensors detect a removal of the sheet from the upper sheet discharge tray 25 or the lower sheet discharge tray 37, a corresponding tray is ascended toward a direction of A1 or B1 in FIG. 1. Accordingly, the upper sheet discharge tray 25 and the lower sheet discharge tray 37 are controlled to ascend and descend so as to constantly maintain the position of the uppermost sheet of stacked sheets.

Configuration of Binding Process Unit

Figure 2:
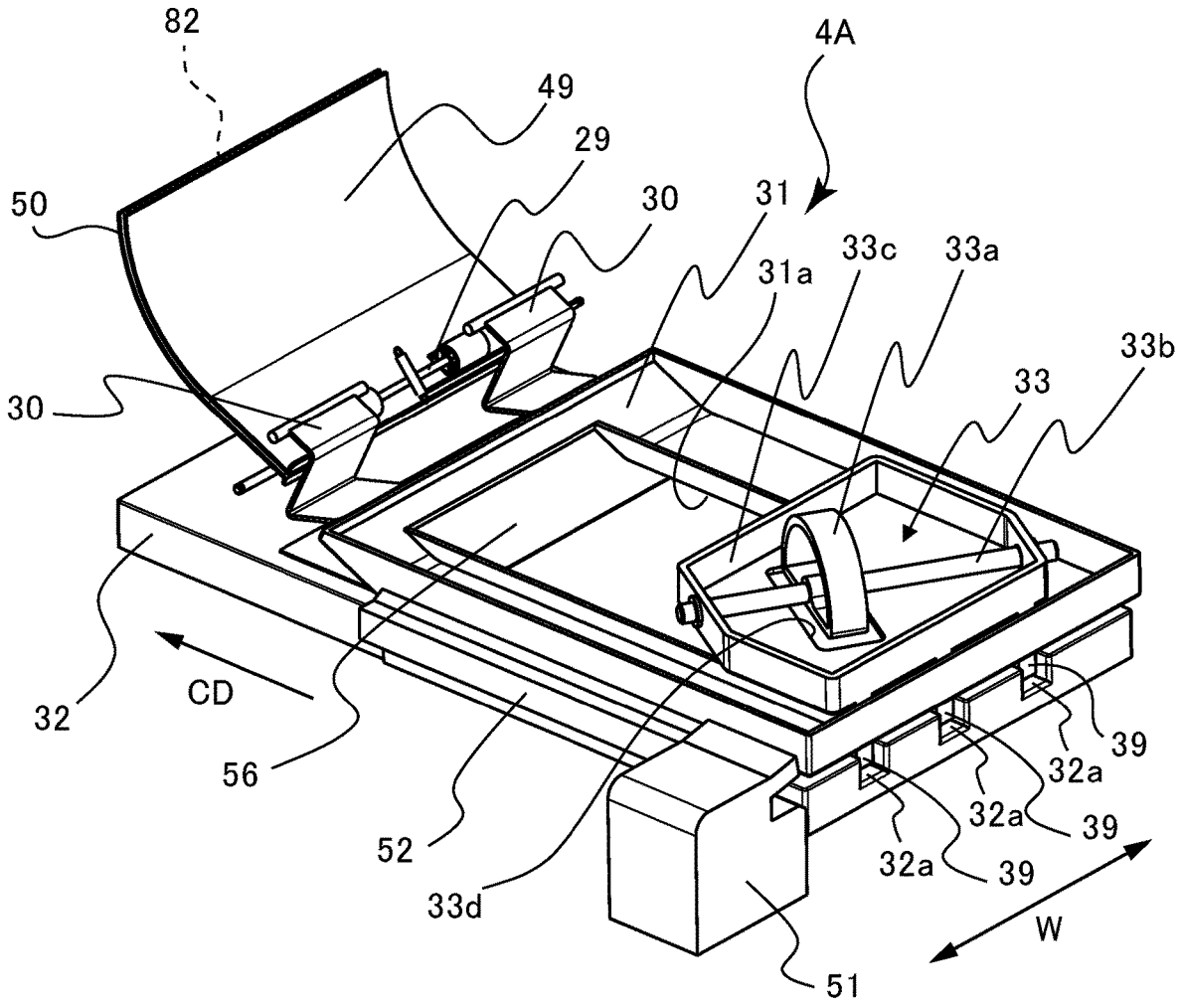
FIG. 2 is a perspective view showing a binding process unit.

Next, the binding process unit 4A will be described. FIG. 2 is a perspective view showing the binding process unit 4A, and some parts of the binding process unit 4A such as a frame member are omitted herein.

As shown in FIGS. 1 and 2, the binding process unit 4A includes a pair of bundle holding flags 30, an intermediate upper guide 31, an intermediate lower guide 32, a holder guide 56, a crosswise alignment reference plate 52, an alignment mechanism 33, and the stapler 51.

The binding process unit 4A performs the binding process, by the stapler 51, of the sheet discharged from the inner discharge path 82, which is composed with an upper conveyance guide 49 and a lower conveyance guide 50, and stacked on an intermediate stacking portion, and composes a bound sheet bundle. The intermediate upper guide 31 and the intermediate lower guide 32 form the intermediate stacking portion to stack the sheet for processing. The intermediate lower guide 32 serves as a stacking portion which stacks the sheet discharged from the pair of the kick-out rollers 29 of a most downstream roller on the inner discharge path 82.

The pair of the bundle holding flags 30 are disposed downstream of the pair of the kick-out rollers 29, which are conveyance members, in a pivotable manner. To be noted, the pair of the kick-out rollers 29 are a pair of rollers as a pair of rotary members to nip and discharge the sheet to the intermediate lower guide 32. Lower surfaces of the pair of the bundle holding flags 30 hold a trailing edge of a preceding sheet, discharged earlier to the intermediate stack portion, and pass a front edge of a succeeding sheet, discharged later by the pair of the kick-out rollers 29, above the trailing edge of the preceding sheet. That is, the pair of the bundle holding flags 30 work as a unit to prevent an impingement of sheets on each other by moving the trailing edge of the sheet discharged from the pair of the kick-out rollers 29 downwards. The lower surfaces of the pair of the bundle holding flags 30 are disposed in a range of positions in a width direction of the sheet so that the lower surfaces of the pair of the bundle holding flags 30 are capable of holding both edges in the width direction of each size of sheets processable by the binding process unit 4A.

To the intermediate upper guide 31, the holder guide 56 of a flexible sheet member is fixed, and the holder guide 56 is configured to abut on the intermediate lower guide 32, and provides a predetermined pressure on an upper surface of the sheet stacked on the intermediate stacking portion. The alignment mechanism 33 is disposed above the intermediate upper guide 31 and the holder guide 56, and includes a holder 33*c* movably supported by a frame member, not shown, an axis portion 33*b* rotatably supported by the holder 33*c*, and an alignment roller 33*a* fixed to the axis portion 33*b*.

From a lower surface of the holder 33*c*, a plurality of longitudinal alignment reference portions 39, as a first regulation portion, are extended downwards, and tip portions of the plurality of the longitudinal alignment reference portions 39 enter into a plurality of slide grooves 32*a*. Therefore, the sheet stacked on the intermediate lower guide 32 securely abuts against the plurality of the longitudinal alignment reference portions 39 by being conveyed by the alignment roller 33*a*, and a position of an edge portion of the sheet in a sheet discharge direction CD is regulated. The plurality of the slide grooves 32*a* extend in the sheet discharge direction CD to make the alignment mechanism 33 movable, as described later. To be noted, the plurality of the longitudinal alignment reference portions 39 are disposed downstream of the alignment roller 33*a* in a conveyance direction of the alignment roller 33*a*. The crosswise alignment reference plate 52 is arranged in a front direction of the intermediate stacking portion, i.e. outside in a width direction, and extends in the sheet discharge direction CD in which the sheet stacked on the intermediate stacking portion is conveyed to the second discharge path 84.

The axis portion 33*b* of the alignment roller 33*a* is inclined with respect to the sheet discharge direction CD, which is the sheet conveyance direction, and a width direction W orthogonal to the sheet discharge direction CD. Therefore, the alignment roller 33*a*, as an alignment unit, rotating around the axis portion 33*b* moves the sheet toward the plurality of the longitudinal alignment reference portions 39 and the crosswise alignment reference plate 52 by abutting against the sheet stacked on the intermediate lower guide 32. That is, the plurality of the longitudinal alignment reference portions 39 become an alignment reference of an upstream edge in the sheet discharge direction CD, and the crosswise alignment reference plate 52 becomes an alignment reference of the sheet in a width direction W.

The alignment roller 33*a* is controlled to intermittently rotate at a time in a predetermined timing by a driving transmission unit, which is not shown, and rotates by rotation of the axis portion 33*b*. The alignment roller 33*a* is formed with molding an elastic material such as a synthetic rubber and an elastomer resin, and a peripheral surface is adjusted to have a predetermined friction coefficient. Further, viewing from an axial direction of the axis portion 33*b*, the circumference of the alignment roller 33*a* is noncircular.

In a stand-by state before the sheet is discharged to the intermediate stacking portion, a rotation angle of the alignment roller 33*a* is maintained so that a roller portion of the alignment roller 33*a* is not exposed from the intermediate upper guide 31. Then, during a one revolution of the alignment roller 33*a*, the roller portion of the alignment roller 33*a* is exposed from an opening portion 33*d* provided in the holder 33*c* and an opening portion 31*a* provided in the intermediate upper guide 31. Then, the roller portion of the alignment roller 33*a* abuts against the upper surface of the uppermost sheet stacked on the intermediate lower guide 32, and provides a conveyance force. A contact pressure of the alignment roller 33*a* on the sheet is adjusted so that the alignment roller 33*a* slips after the sheet has abutted on the plurality of the longitudinal alignment reference portions 39 and the crosswise alignment reference plate 52.

The sheet aligned by the crosswise alignment reference plate 52, the plurality of the longitudinal alignment reference portions 39, and the alignment mechanism 33 is pushed out in the sheet discharge direction CD as the alignment mechanism 33 is moved by a driving unit, not shown, in the sheet discharge direction CD.

Movement of Binding Process Unit

Figure 3A:
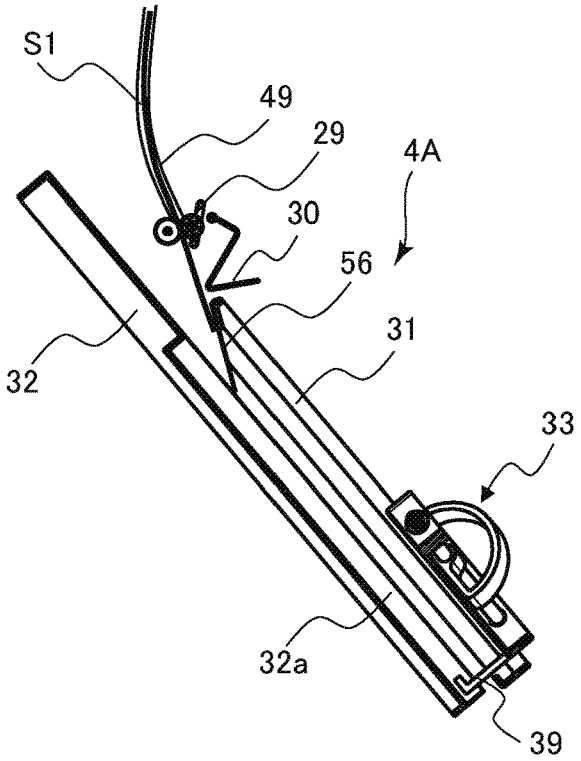
FIG. 3A is a side view of the binding process unit to illustrate a movement of the binding process unit.
Figure 3B:
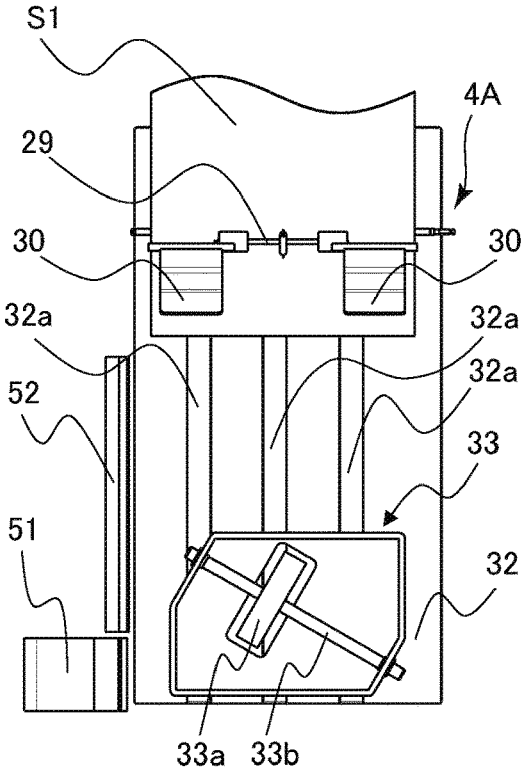
FIG. 3B is a front view of the binding process unit to illustrate the movement of the binding process unit.
Figure 3C:
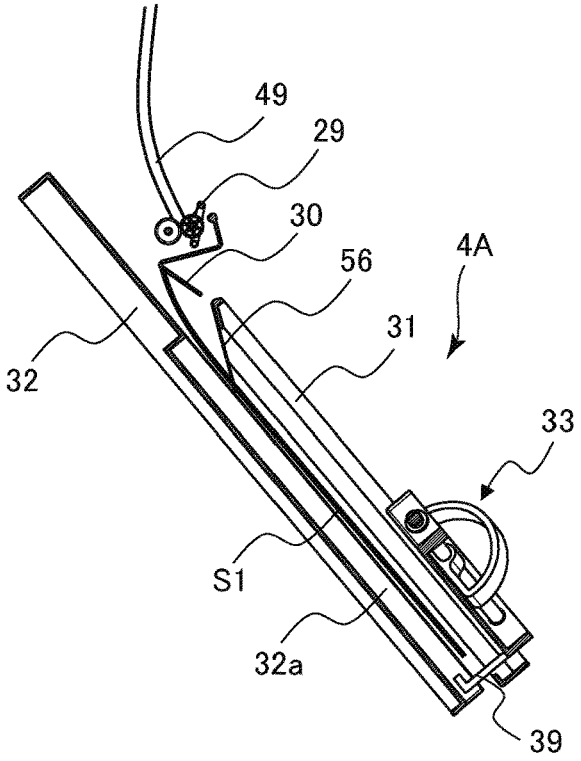
FIG. 3C is the side view of the binding process unit to illustrate the movement of the binding process unit.
Figure 3D:
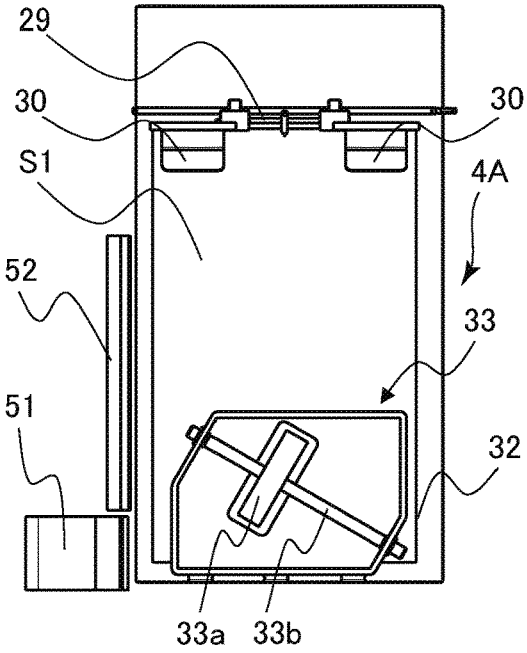
FIG. 3D is the front view of the binding process unit to illustrate the movement of the binding process unit.

Next, a movement of the binding process unit 4A will be described referring to FIGS. 3A to 6B. As shown in FIGS. 3A and 3B, when a first sheet S1 of the sheet starts entering into the intermediate stacking portion of the binding process unit 4A, the pair of the bundle holding flags 30 are lifted accompanied with an entrance of the sheet S1, and retreat from a sheet discharging path. Then, as shown in FIGS. 3C and 3D, after a trailing edge of the sheet S1 has passed the pair of the kick-out rollers 29, the pair of the bundle holding flags 30 return to a stand-by position, and drop the sheet S1 on the intermediate lower guide 32. Herewith, the sheet S1 is in a state of temporally nipped with the holder guide 56 and the intermediate lower guide 32.

Figure 4A:
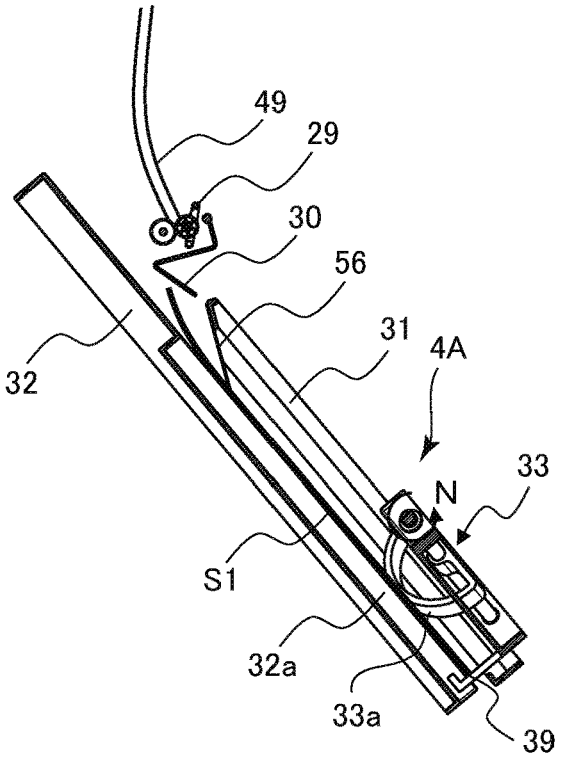
FIG. 4A is the side view of the binding process unit to illustrate the movement of the binding process unit.
Figure 4B:
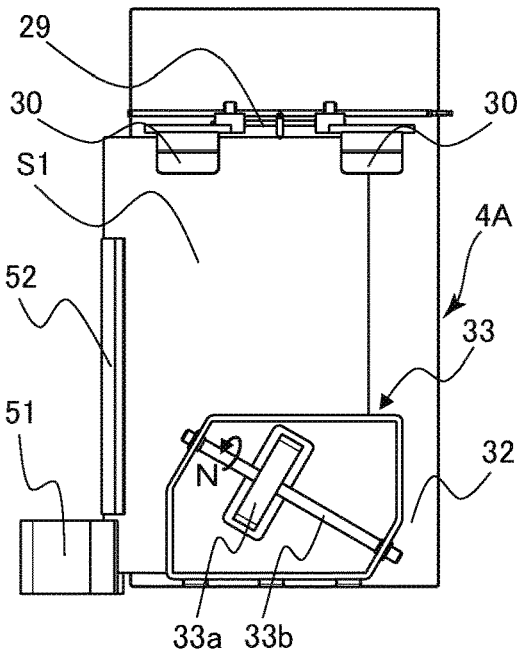
FIG. 4B is the front view of the binding process unit to illustrate the movement of the binding process unit.
Figure 4C:
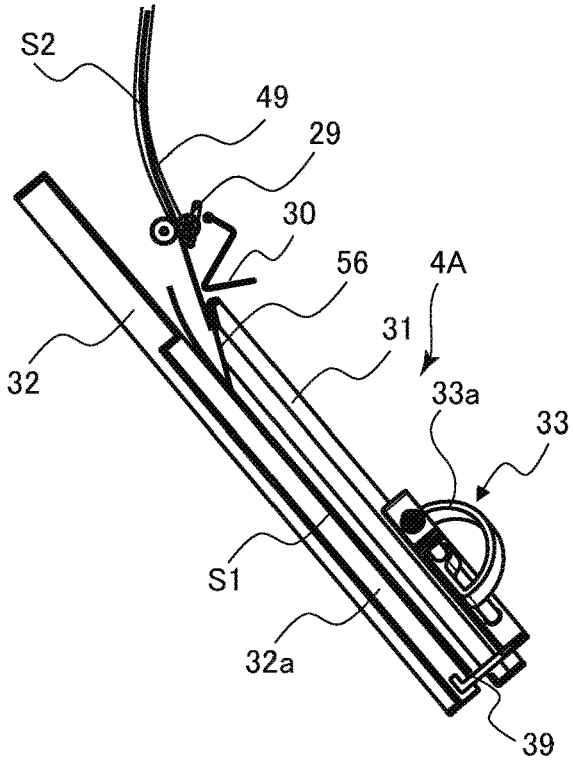
FIG. 4C is the side view of the binding process unit to illustrate the movement of the binding process unit.
Figure 4D:
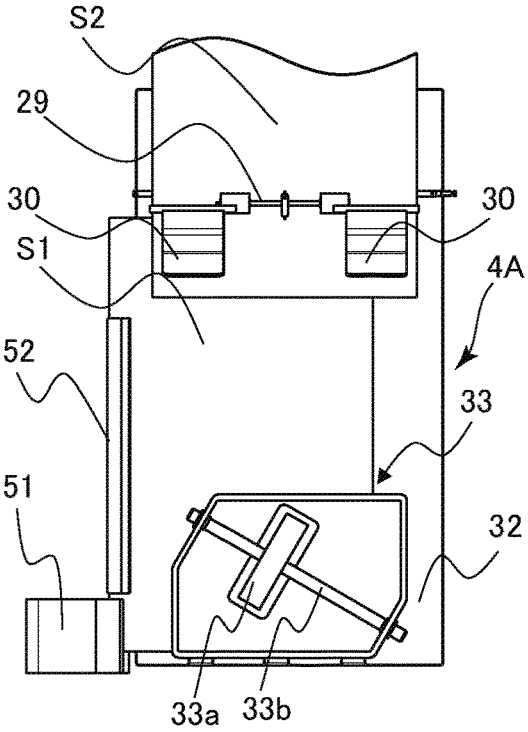
FIG. 4D is the front view of the binding process unit to illustrate the movement of the binding process unit.

Next, as shown in FIGS. 4A and 4B, as the alignment roller 33*a* is driven in an arrow N direction, the sheet S1 is abutted on plurality of the longitudinal alignment reference portions 39 and the crosswise alignment reference plate 52. Thus, the sheet S1 is aligned along the plurality of the longitudinal alignment reference portions 39 and the crosswise alignment reference plate 52. As shown in FIGS. 4C and 4D, when the alignment roller 33*a* retreats above the intermediate upper guide 31, a succeeding sheet S2 starts entering into the binding process unit 4A. Herewith, the pair of the bundle holding flags 30 are lifted again accompanied with an entrance of the sheet S2.

Figure 5A:
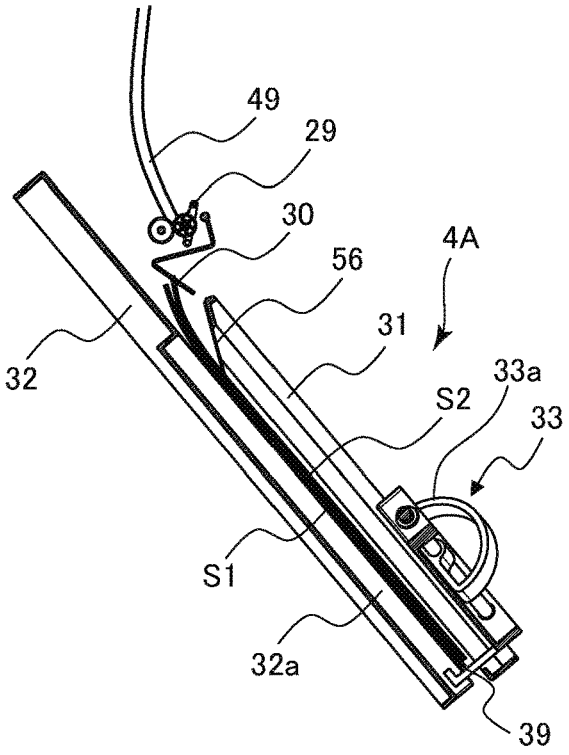
FIG. 5A is the side view of the binding process unit to illustrate the movement of the binding process unit.
Figure 5B:
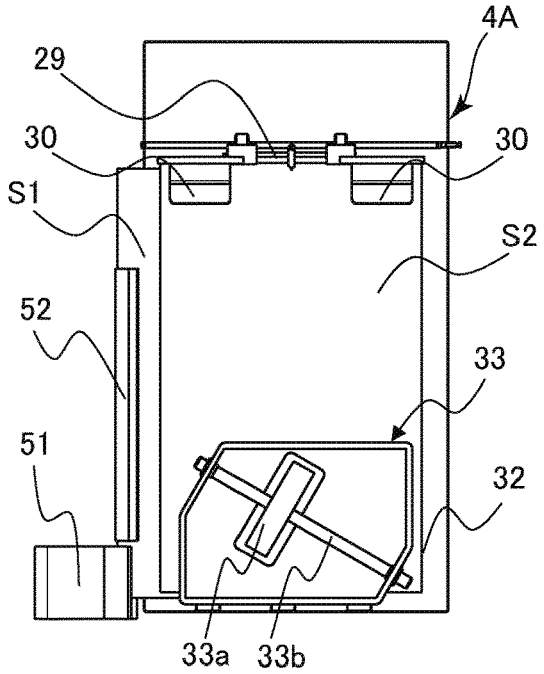
FIG. 5B is the front view of the binding process unit to illustrate the movement of the binding process unit.
Figure 5C:
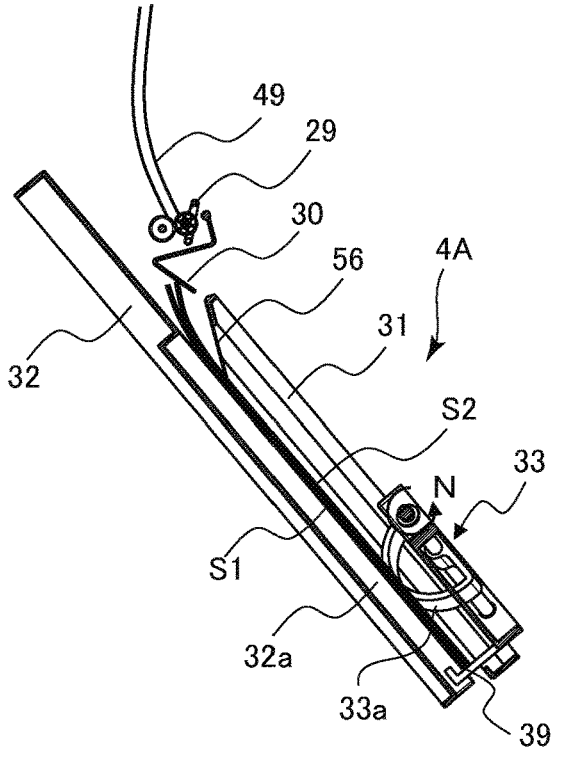
FIG. 5C is the side view of the binding process unit to illustrate the movement of the binding process unit.
Figure 5D:
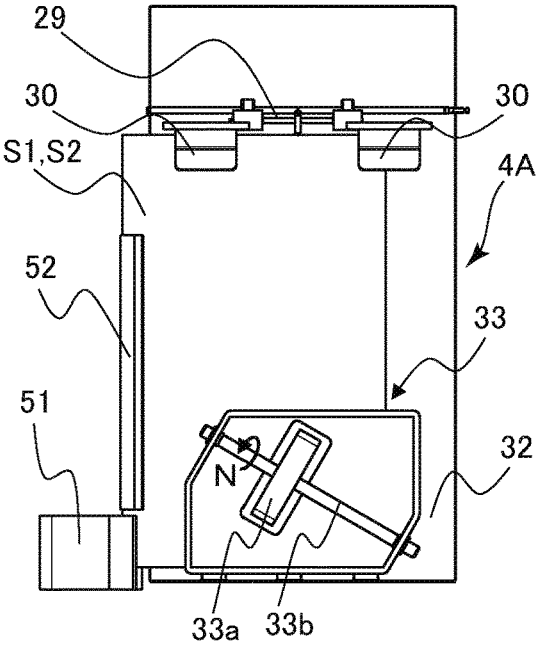
FIG. 5D is the front view of the binding process unit to illustrate the movement of the binding process unit.

As shown in FIGS. 5A and 5B, after a trailing edge of the sheet S2 has passed the pair of the kick-out rollers 29, the pair of the bundle holding flags 30 return to the stand-by position, and drop the sheet S2 on the intermediate lower guide 32. Herewith, the sheet S2 is in a state of temporally nipped by the holder guide 56 and the intermediate lower guide 32. Further, as shown in FIGS. 5C and 5D, as the alignment roller 33*a* is driven in the arrow N direction, the sheet S2 is abutted on the plurality of the longitudinal alignment reference portions 39 and the crosswise alignment reference plate 52. Thus, the sheet S2 is aligned along the plurality of the longitudinal alignment reference portions 39 and the crosswise alignment reference plate 52.

Figure 6A:
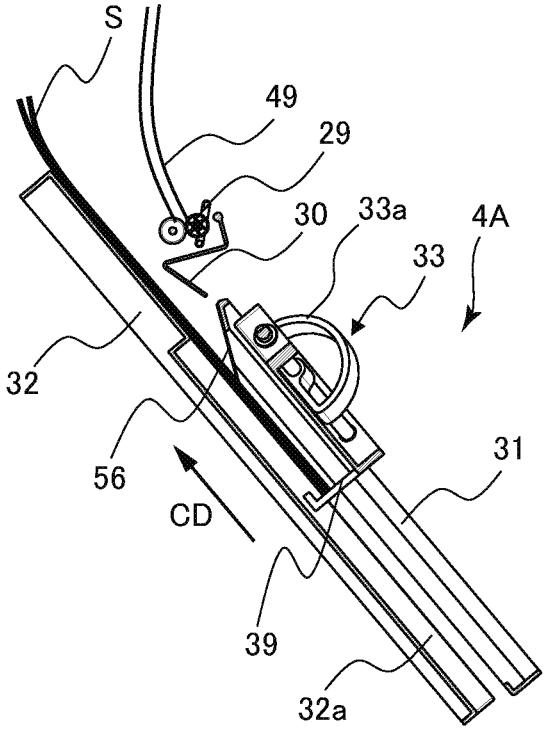
FIG. 6A is the side view of the binding process unit to illustrate the movement of the binding process unit.
Figure 6B:
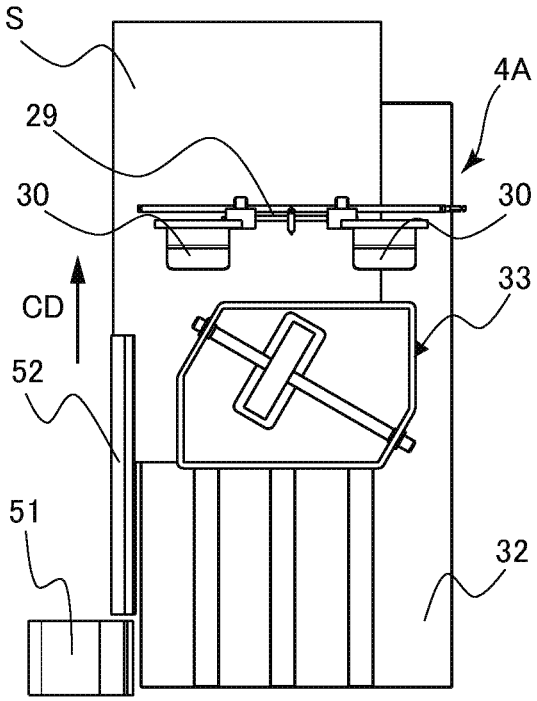
FIG. 6B is the front view of the binding process unit to illustrate the movement of the binding process unit.

Hereafter, a sheet alignment movement is repeated until the alignment of a last sheet constituting the sheet bundle is completed. Then, when the sheet alignment movement on the last sheet is completed, the stapler 51 binds the predetermined position of the sheet bundle. As shown in FIGS. 6A and 6B, when a binding movement is carried out by the stapler 51, the alignment mechanism 33 moves in parallel in the sheet discharge direction CD, and the sheet bundle is pushed out in the sheet discharge direction CD by the plurality of the longitudinal alignment reference portions 39 of the alignment mechanism 33. Then, the sheet bundle is delivered to the pair of the bundle discharge rollers 36, and stacked on the lower sheet discharge tray 37.

Comparative Example

Figure 7A:
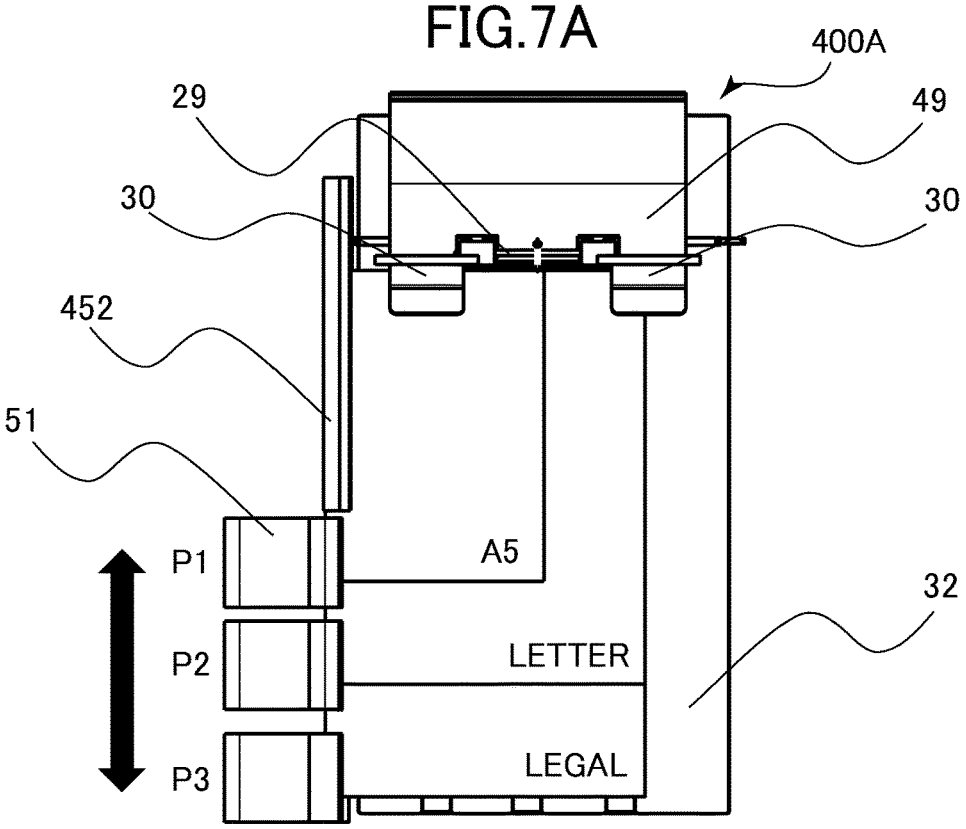
FIG. 7A is a front view of a binding process unit according to a comparative example.

Next, with reference to FIGS. 7A and 7B, a comparative example to this embodiment will be described. A binding process unit 400A of the comparative example and the binding process unit 4A of this embodiment are similar in structures except that a crosswise alignment reference plate 452 is unmovable to the intermediate lower guide 32 in the binding process unit 400A.

For example, in a case where the binding process unit 400A is capable of processing sheet sizes of an A5-size to a legal-size and the stapler 51 binds a corner portion of these A5 to legal-size sheets, the stapler 51 moves in a range of positions P1 to P3. Then, it is unable to dispose a crosswise alignment reference plate 452 within a range of the positions P1 to P3, which is a moving range of the stapler 51, to prevent an impingement of the stapler 51 on the crosswise alignment reference plate 452. Therefore, the crosswise alignment reference plate 452 is fixed at a position shown in FIGS. 7A and 7B.

Figure 7B:
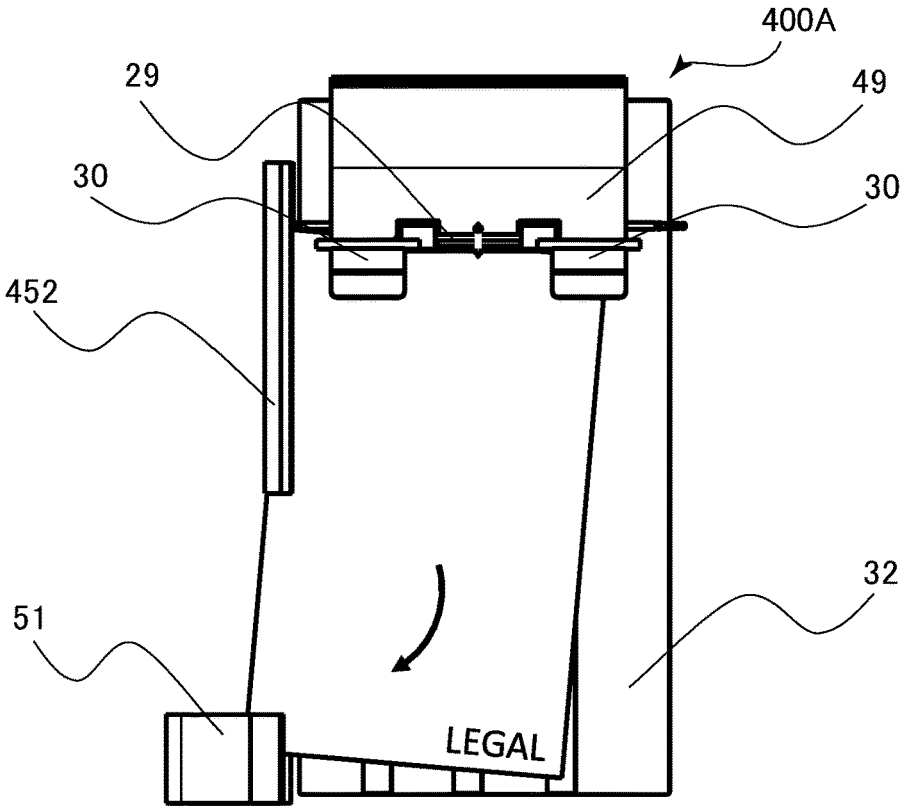
FIG. 7B is the front view of the binding process unit showing a rotating movement of the sheet.

However, as shown in FIG. 7B, in a case where the binding process is performed, for example, on the legal-size sheet, since the crosswise alignment reference plate 452 is substantially separated from the stapler 51 and the plurality of the longitudinal alignment reference portions, not shown, the sheet may be rotated to cause a deteriorated alignment.

Figure 8A:
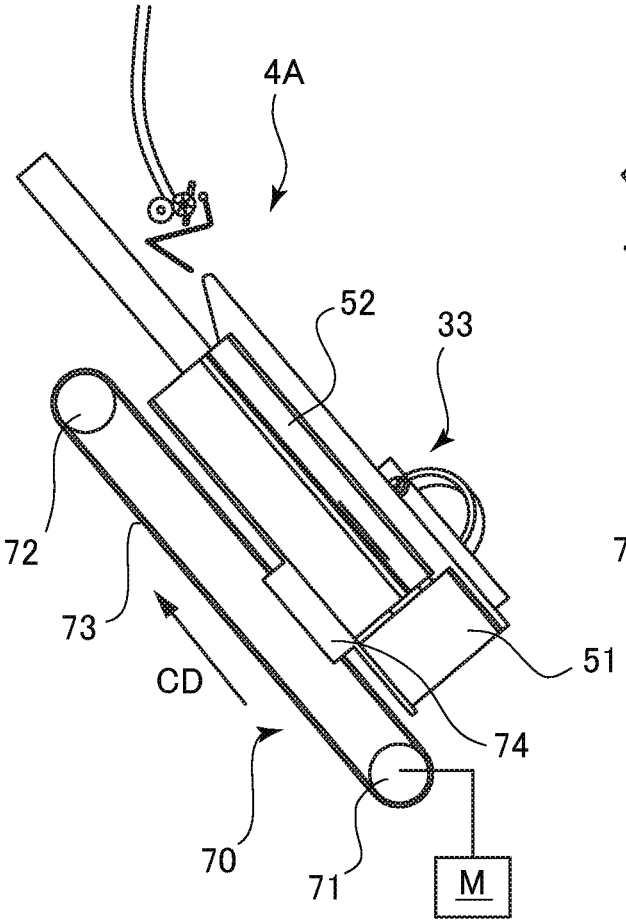
FIG. 8A is a side view of a moving unit according to the first embodiment.

Therefore, in this embodiment, as shown in FIG. 8A, a moving unit 70 is provided to the binding process unit 4A. The moving unit 70 includes a driving motor M as a driving source, a driving pulley 71 driven by the driving motor M, a driven pulley 72, a belt 73 of endless-shaped wound around by the driving pulley 71 and the driven pulley 72, and a link member 74 coupled to the belt 73. The link member 74 supports the stapler 51 and the crosswise alignment reference plate 52. That is, the belt 73 is coupled to the stapler 51, as a binding member, and the crosswise alignment reference plate 52, as a second regulation member, via the link member 74.

When the driving pulley 71 is rotated by the driving motor M from a state shown in FIG. 8A in an arrow R1 direction, the belt 73 rotates in an arrow R2 direction, and the link member 74 fixed to the belt 73 moves accompanied by the belt 73. Thus, the stapler 51 and the crosswise alignment reference plate 52 moves in the sheet discharge direction CD. In other words, the moving unit 70, accompanied with a movement of the stapler 51 in the sheet discharge direction CD, moves the crosswise alignment reference plate 52 in the sheet discharge direction CD.

Figure 9A:
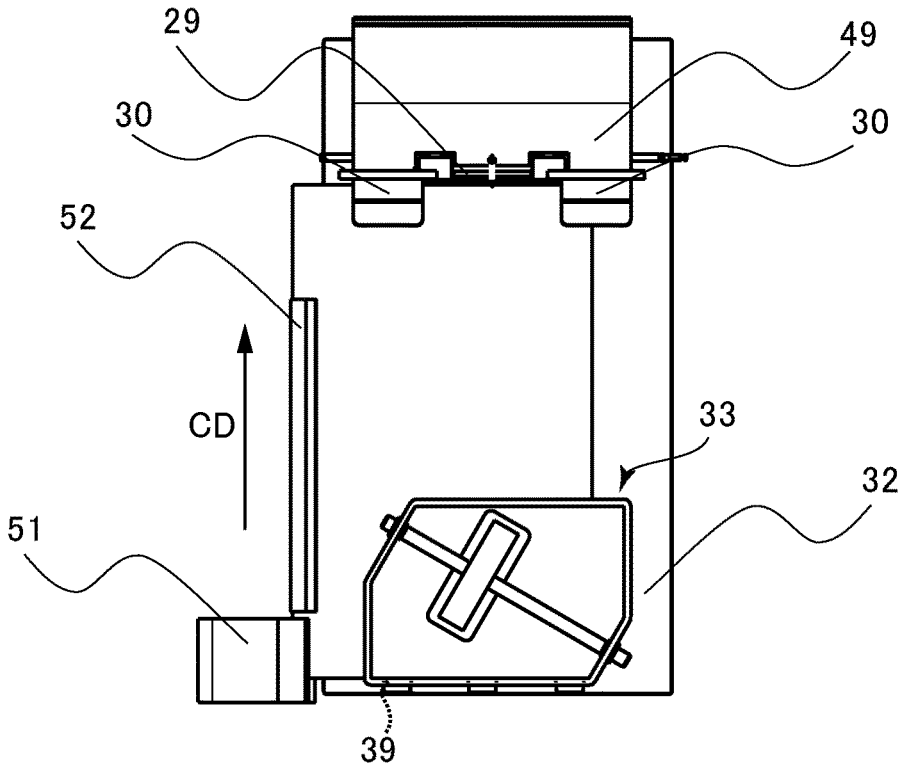
FIG. 9A is the front view of the binding process unit showing a position of a crosswise alignment reference plate in alignment of a legal-size sheet.
Figure 9B:
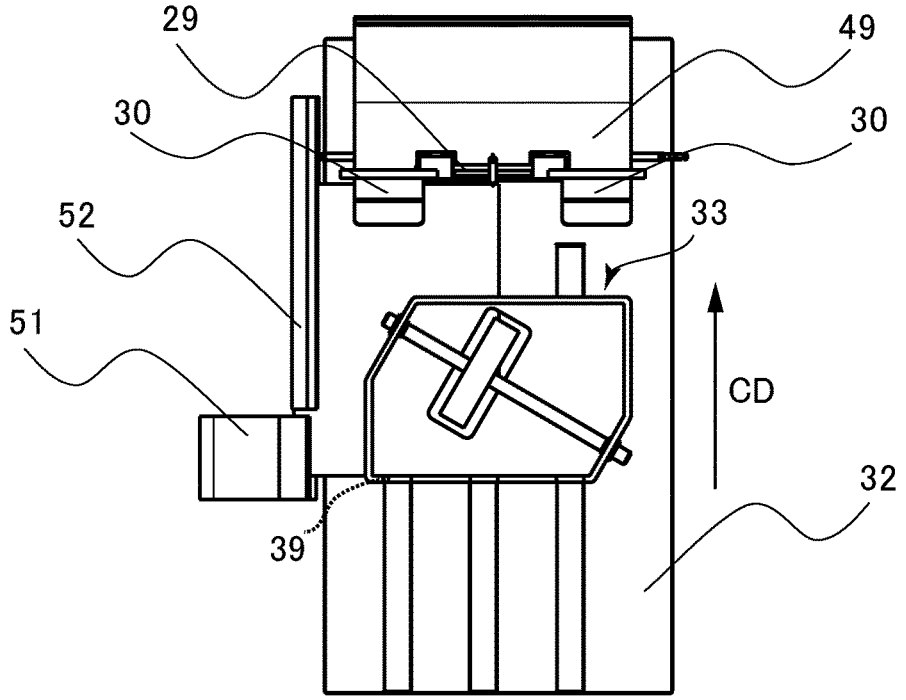
FIG. 9B is the front view of the biding process unit showing the position of the crosswise alignment reference plate in the alignment of an A5-size sheet.

Herewith, a design restriction of the comparative example, as described above, of unable to dispose the crosswise alignment reference plate 52 within the moving range of the stapler 51 is eliminated, and it is possible to dispose the crosswise alignment reference plate 52 in adjacent to the stapler 51 and the plurality of the longitudinal alignment reference portions 39. In more particular, for example, in a case of the binding process to the legal-size sheet as shown in FIG. 9A and also even in a case of the binding process to the A5-size sheet as shown in FIG. 9B, it is possible to dispose the crosswise alignment reference plate 52 in adjacent to the stapler 51 and the plurality of the longitudinal alignment reference portions 39. Therefore, it is possible to improve the alignment of the sheet even in a case where the postprocessing apparatus 4 is capable of performing the binding process to a plurality of sizes of the sheet.

Second Embodiment

Although a second embodiment according to the present invention will be described next, a configuration of the crosswise alignment reference plate 52 of the first embodiment is changed in the second embodiment. Therefore, drawings of configurations similar to the first embodiment are omitted herein, or described by putting a same mark on drawings.

Figure 10A:
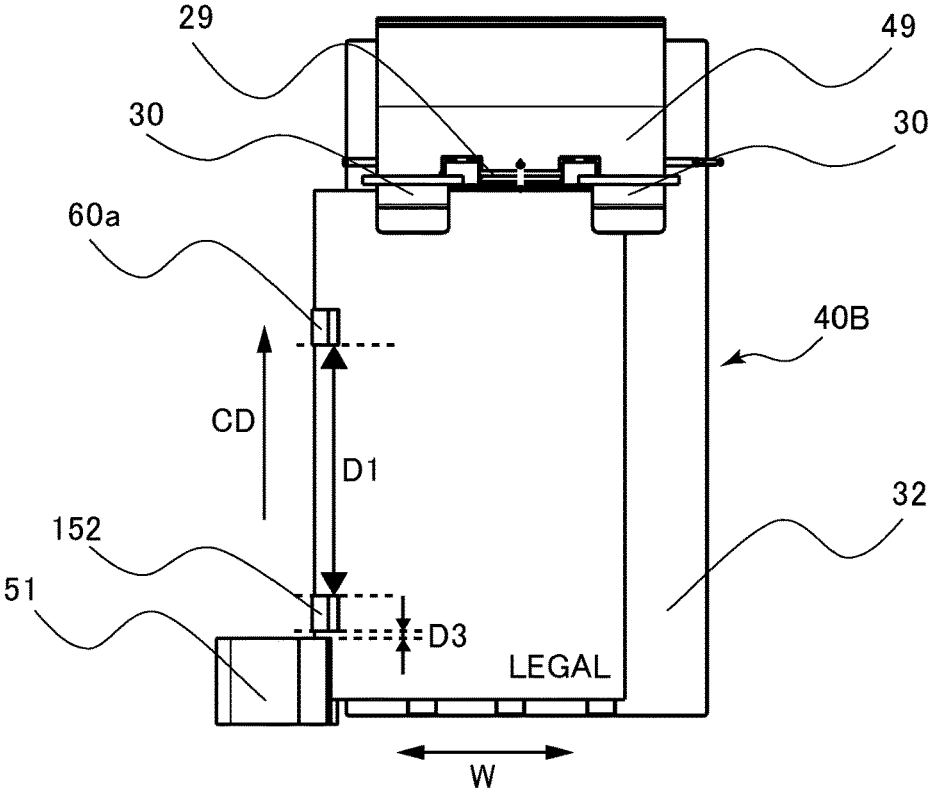
FIG. 10A is a front view of a binding process unit according to a second embodiment showing a position of a movable crosswise alignment reference member in the alignment of the legal-size sheet.
Figure 10B:
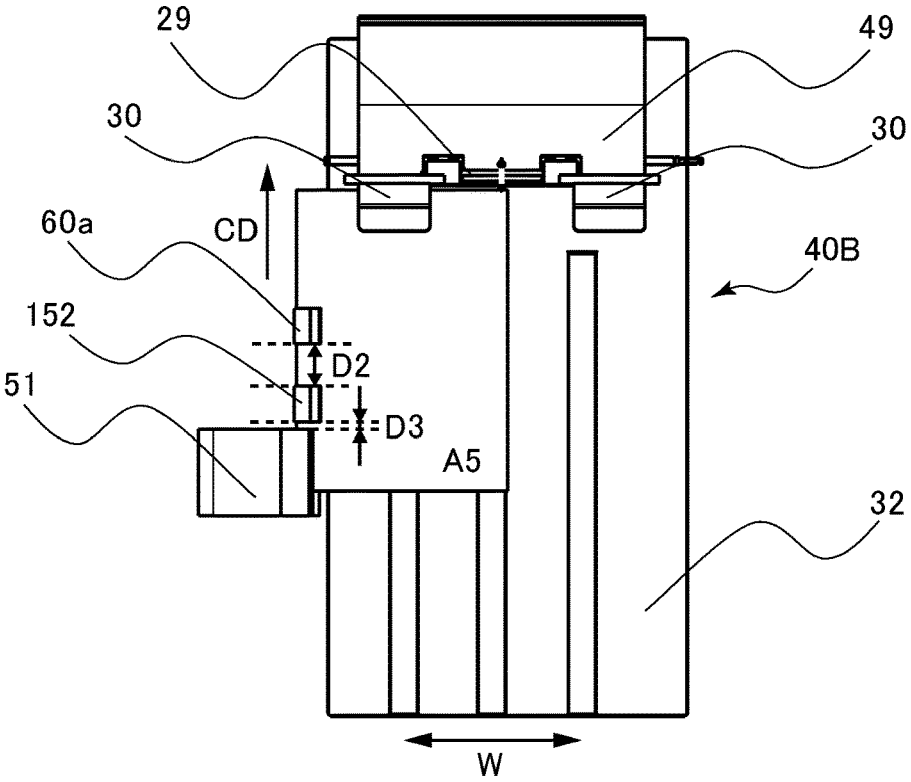
FIG. 10B is the front view of the binding process unit showing the position of the movable crosswise alignment reference member in the alignment of the A5-size sheet.

A binding process unit 40B according to the second embodiment includes, as shown in FIGS. 10A and 10B, a movable crosswise alignment reference member 152 as the second regulation member and a fixed crosswise alignment reference member 60*a*. The fixed crosswise alignment reference member 60*a*, as a third regulation member, is disposed at an opposite side of the stapler 51 across the movable crosswise alignment reference member 152. In other words, the fixed crosswise alignment reference member 60*a* is disposed at a different position from the movable crosswise alignment reference member 152 in the sheet discharge direction CD. These crosswise alignment reference members, i.e. the movable crosswise alignment reference member 152 and the fixed crosswise alignment reference member 60*a* regulate an edge position in a width direction of the sheet stacked on the intermediate lower guide 32. To be noted, a method of the alignment is similar to a method described in the first embodiment.

Figure 8B:
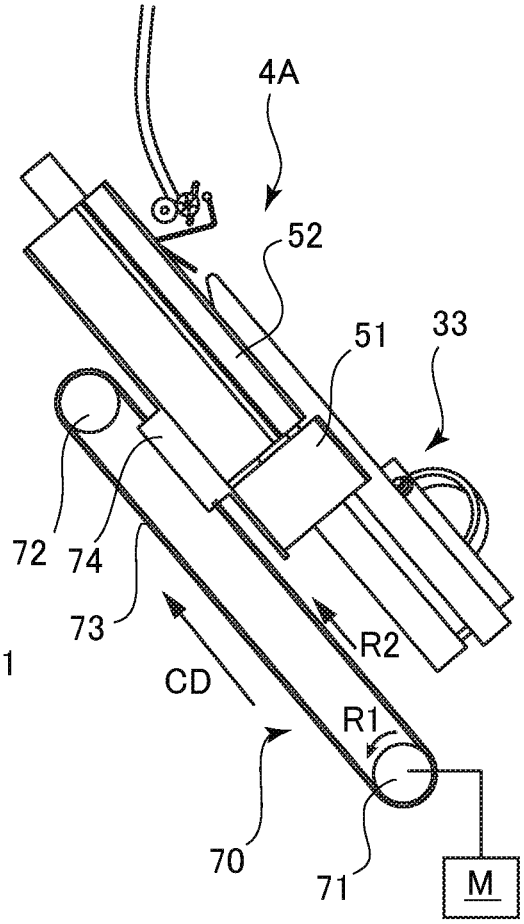
FIG. 8B is a side view of the moving unit with a driving motor driving.

The movable crosswise alignment reference member 152 moves in a similar configuration of the moving unit 70, as described in FIGS. 8A and 8B, in the sheet discharge direction CD accompanied with the movement of the stapler 51. On the other hand, the fixed crosswise alignment reference member 60*a* is fixed to the intermediate lower guide 32, and does not move when the stapler 51 and the movable crosswise alignment reference member 152 are moved by the moving unit 70. To be noted, the fixed crosswise alignment reference member 60*a* is disposed at a position where the fixed crosswise alignment reference member 60*a* is able to abut on a minimum size sheet which the binding process unit 40B can process.

As shown in FIG. 10A, in a case of the alignment of the legal-size sheet, a distance between the fixed crosswise alignment reference member 60*a* and the movable crosswise alignment reference member 152 is a distance D1. Then, at this time, a distance between the movable crosswise alignment reference member 152 and the stapler 51 is a distance D3. On the other hand, as shown in FIG. 10B, in a case of the alignment of the A5-size sheet, the distance between the fixed crosswise alignment reference member 60*a* and the movable crosswise alignment reference member 152 is a distance D2. At this time, the distance between the movable crosswise alignment reference member 152 and the stapler 51 is the distance D3 which is the same as the case of FIG. 10A.

Thus, the distance D3 of the distance between the movable crosswise alignment reference member 152 and the stapler 51 is set to be smaller than the distance D1 and the distance D2 of the distance between the fixed crosswise alignment reference member 60*a* and the movable crosswise alignment reference member 152. That is, it is possible to dispose the crosswise alignment reference plate 52 in adjacent to the stapler 51 and the plurality of the longitudinal alignment reference portions 39 (refer to FIG. 9A). Accordingly, it is possible to improve the alignment of the sheet even in a case of the postprocessing apparatus which is capable of processing the plurality of the sizes of the sheet.

As described above, although in the first embodiment the width direction W of the sheet is aligned by the crosswise alignment reference plate 52 which is configured with one piece of a large size member, the sheet is aligned by two pieces of members of the movable crosswise alignment reference member 152 and the fixed crosswise alignment reference member 60*a* in this embodiment. Thus, it is possible to reduce a size of each of the movable crosswise alignment reference member 152 and the fixed crosswise alignment reference member 60*a*, and is possible to reduce a size of a whole apparatus and bring a cost down.

Third Embodiment

Although a third embodiment according to the present invention will be described next, a configuration of the fixed crosswise alignment reference member 60*a* of the second embodiment is changed in the third embodiment. Therefore, drawings of configurations similar to the second embodiment are omitted herein, or described by putting a same mark on drawings.

Figure 11A:
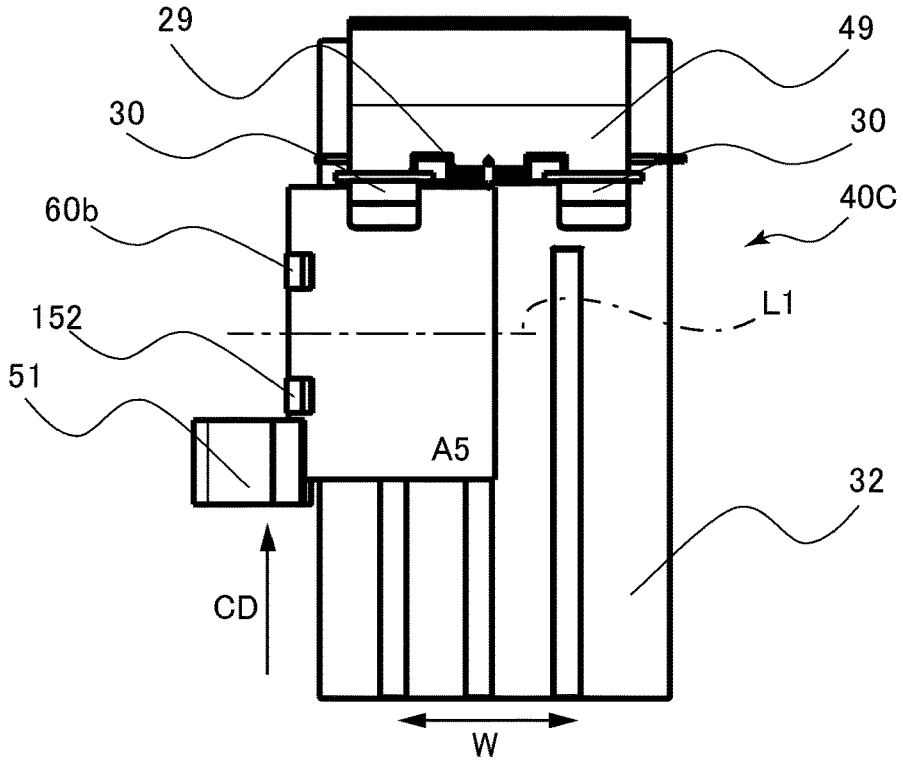
FIG. 11A is a front view of a binding process unit according to a third embodiment showing movable crosswise alignment reference members.
Figure 11B:
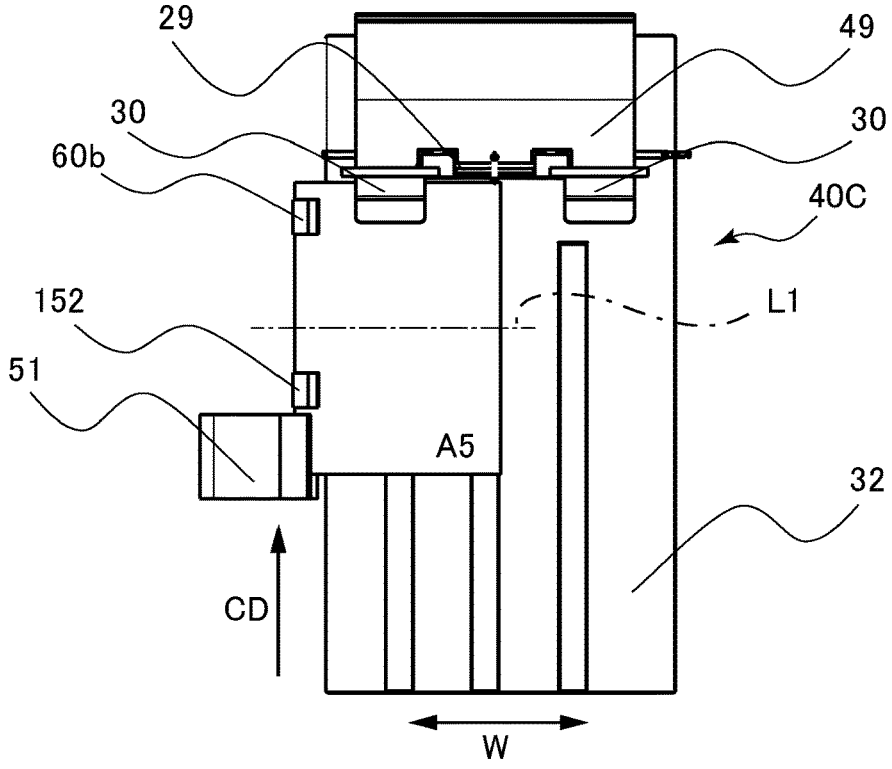
FIG. 11B is the front view of the binding process unit showing the movable crosswise alignment reference members.

As shown in FIGS. 11A and 11B, a binding process unit 40C according to the third embodiment includes movable crosswise alignment reference members 60*b* and 152. As a fourth regulation member, the movable crosswise alignment reference member 60*b* is disposed at an opposite side of the stapler 51 across the movable crosswise alignment reference member 152 in the sheet discharge direction CD. In other words, the movable crosswise alignment reference member 60*b* is disposed at a different position from the movable crosswise alignment reference member 152 in the sheet discharge direction CD. These movable crosswise alignment reference members 60*b* and 152 regulate the edge position of the sheet stacked on the intermediate lower guide 32 in the width direction. To be noted, a method of the alignment of the sheet is similar to the method described in the first embodiment.

The movable crosswise alignment reference members 60*b* and 152 are configured to be independently movable each other in the sheet discharge direction CD. For example, the movable crosswise alignment reference member 152 moves by a similar configuration of the moving unit 70, described in FIGS. 8A and 8B, in the sheet discharge direction CD accompanied with the movement of the stapler 51. On the other hand, the movable crosswise alignment reference member 60*b* is coupled to a belt which is driven by a different driving source from the driving motor M, and configured to be movable by rotation of the belt.

By configurations as described above, for example, as shown in FIG. 11A, it is possible to dispose the movable crosswise alignment reference members 60*b* and 152 symmetrically each other with respect to a center line L1 of the sheet discharge direction CD. Further, for example, as shown in FIG. 11B, it is possible to dispose the movable crosswise alignment reference members 60*b* and 152 at various positions in accordance with characteristics of the sheet such as a weight balance and a surface characteristic. Thus, it is possible to improve the alignment of the sheet of a variety of properties.

Fourth Embodiment

Although a fourth embodiment according to the present invention will be described next, a configuration of the movable crosswise alignment reference member 152 of the second embodiment is changed in the fourth embodiment. Therefore, drawings of configurations similar to the second embodiment are omitted herein, or described by putting a same mark on drawings.

Figure 12A:
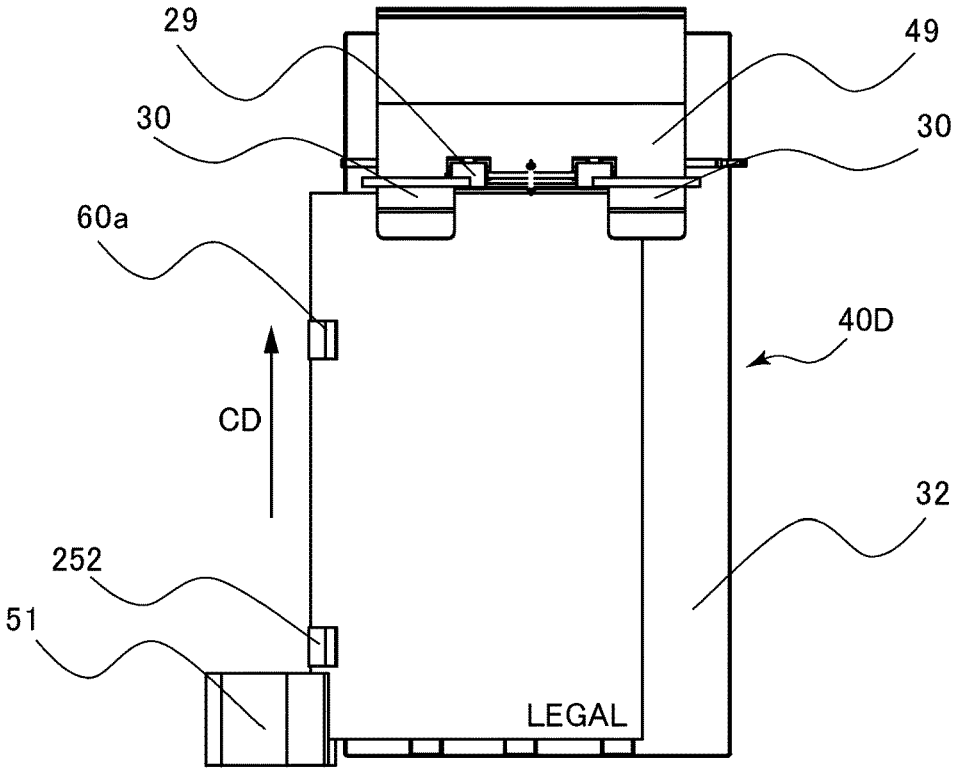
FIG. 12A is a front view of a binding process unit according to a fourth embodiment showing a position of a stapler in an alignment movement.
Figure 12B:
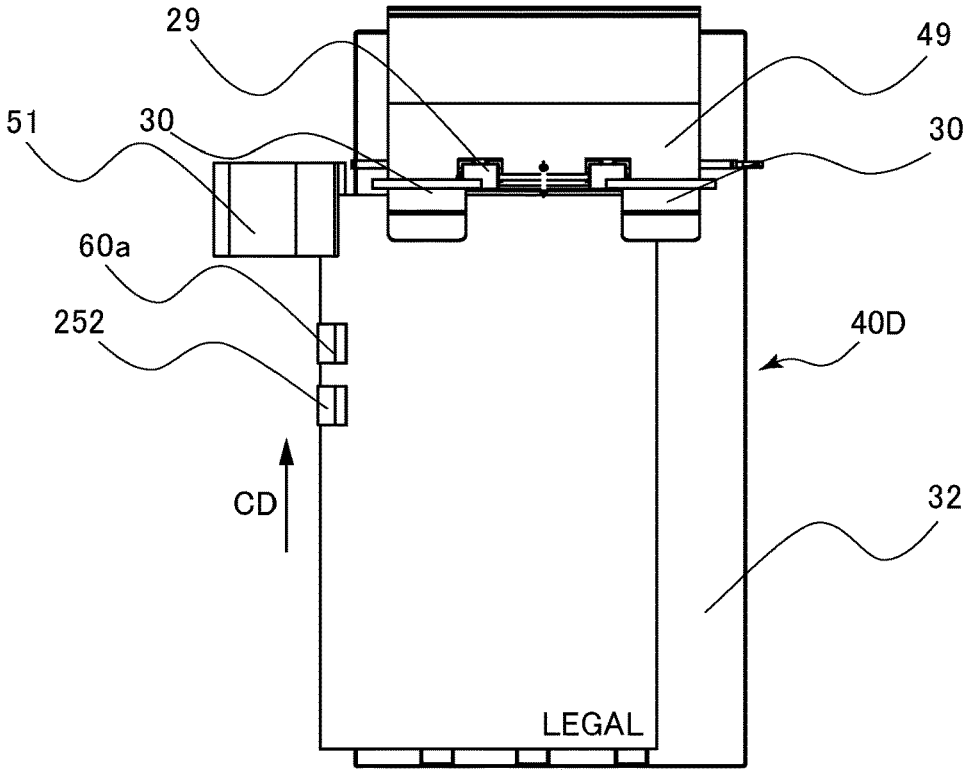
FIG. 12B is the front view of the binding process unit showing the position of the stapler at completion of a binding process.

As shown in FIGS. 12A and 12B, although a binding process unit 40D according to the fourth embodiment is similar to the second embodiment in terms of configurations during an alignment movement, as shown in FIGS. 12A and 12B, the stapler 51 is movable to an upper left side in FIGS. 12A and 12B to perform the binding process after the completion of the alignment movement. Although the movable crosswise alignment reference member 252, as the second regulation member, moves accompanied with the movement of the stapler 51, the movable crosswise alignment reference member 252 stops before abutting against the fixed crosswise alignment reference member 60*a* by abutting against a stopper portion 32*b*.

Figure 13:
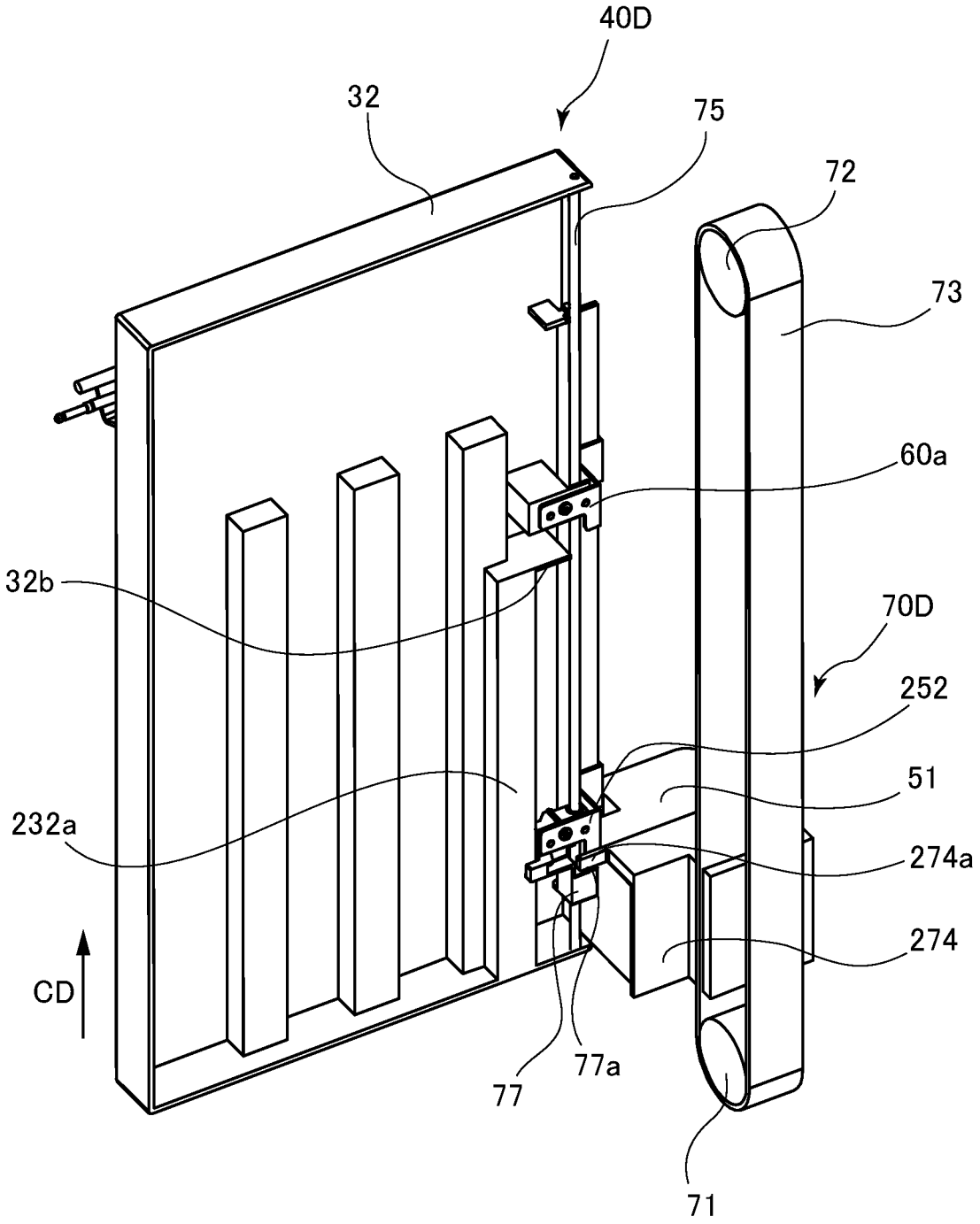
FIG. 13 is a perspective view showing a movable crosswise alignment reference member and a moving unit.
Figure 14:
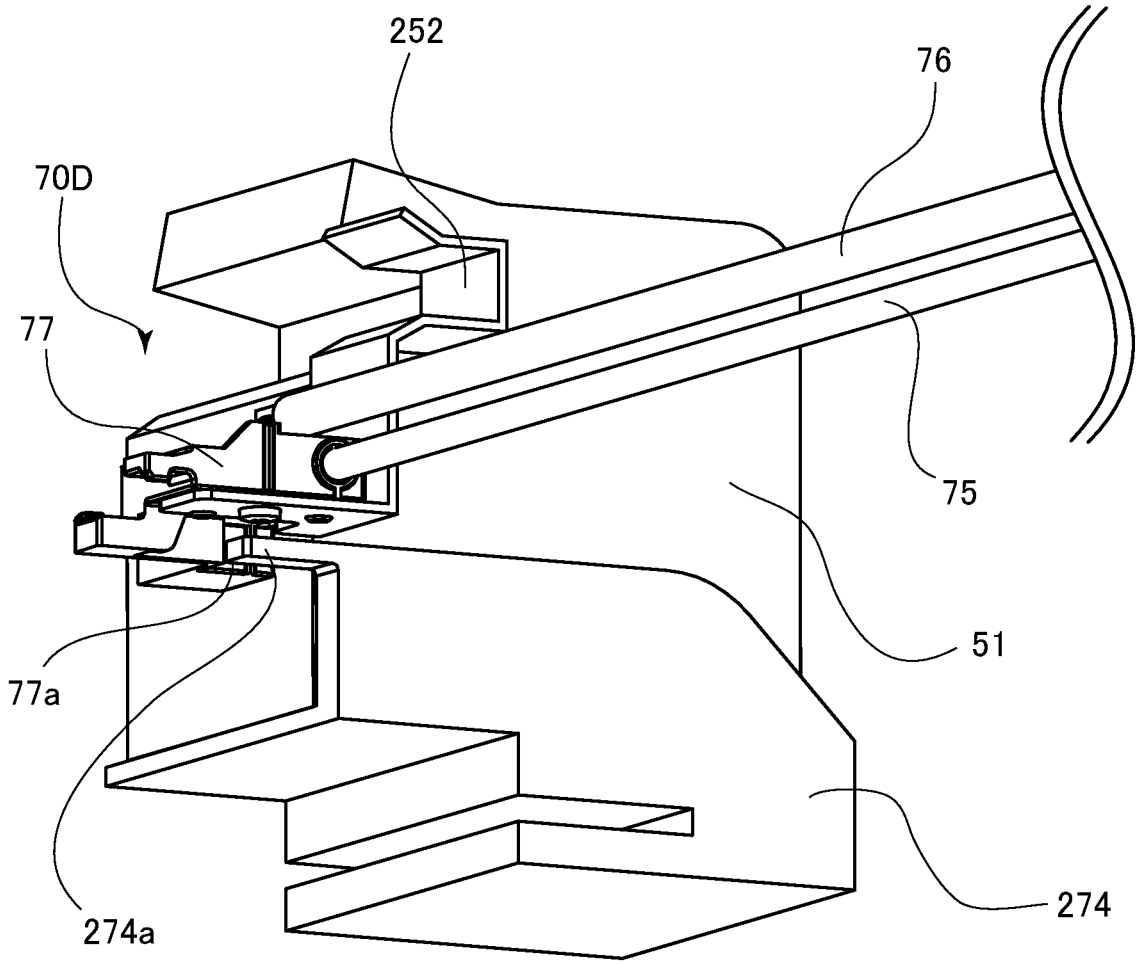
FIG. 14 is a perspective view showing the stapler, the movable crosswise alignment reference member and the moving unit.

Referring to FIGS. 13 and 14, movements of the stapler 51 and the movable crosswise alignment reference member 252 will be described in detail. The binding process unit 40D includes a moving unit 70D which moves the movable crosswise alignment reference member 252 to the sheet discharge direction CD accompanied with the movement of the stapler 51 in the sheet discharge direction CD. The moving unit 70D includes the driving motor M, the driving pulley 71 driven by the driving motor M, the driven pulley 72, the belt 73 of endless-shaped wound around by the driving pulley 71 and the driven pulley 72, a holder 274, a slider 77, and a stopper portion 32*b*. The fixed crosswise alignment reference member 60*a* is fixed to the intermediate lower guide 32.

To the belt 73, the holder 274 is coupled, and to the holder 274, the stapler 51 is fixed. The slider 77 is held by a guide rib 232*a*, provided in the intermediate lower guide 32, and guide shaft 75 in a manner of capable of sliding smoothly in the sheet discharge direction CD, and the movable crosswise alignment reference member 252 is fixed to the slider 77. Further, a spring 76 is coupled to the slider 77, the spring 76, as an urging member, urges the slider 77 downstream in the sheet discharge direction CD. A contact portion 77*a* of the slider 77 is pressed on a contact portion 274*a* of the holder 274 by an urging force of the spring 76. Herewith, the slider 77 and the movable crosswise alignment reference member 252 fixed to the slider 77 follow the movement of the stapler 51 in the sheet discharge direction CD.

When the stapler 51 moves downstream in the sheet discharge direction CD, a part of the slider 77 abuts against the stopper portion 32*b* provided at a lower side of the intermediate lower guide 32, and sliding movements of the slider 77 and the movable crosswise alignment reference member 252 fixed to the slider 77 are stopped. At this time, the movable crosswise alignment reference member 252 stops upstream of the fixed crosswise alignment reference member 60*a* in the sheet discharge direction CD. When the belt 73 is driven in this condition, while the slider 77 and the movable crosswise alignment reference member 252 are stopping, the stapler 51 moves downstream in the sheet discharge direction CD. That is, the stapler 51 relatively moves with respect to the movable crosswise alignment reference member 252 in the sheet discharge direction CD. When the stapler 51 moves upstream in the sheet discharge direction CD, the slider 77 stopped by abutting against the stopper portion 32*b* abuts on the contact portion 274*a* of the holder 274 again, and the stapler 51 and the slider 77 move integrally.

Figure 15:
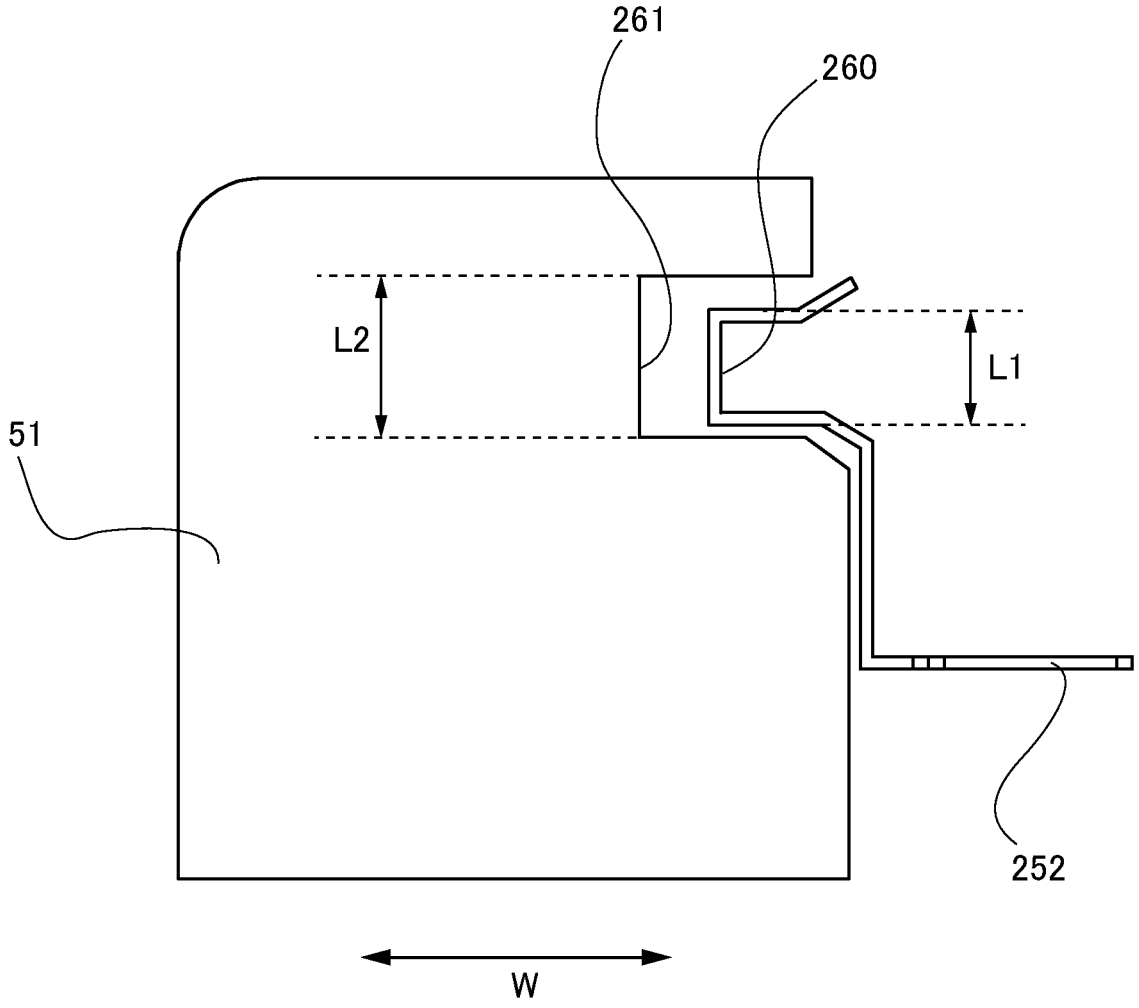
FIG. 15 is a schematic-view of the stapler and the movable crosswise alignment reference member.

FIG. 15 is a schematic view showing the stapler 51 and the movable crosswise alignment reference member 252. As shown in FIG. 15, the stapler 51 includes a recess portion 261 of a rectangular shape with one side open into which a part of the sheet to be processed with the binding process enters, and the movable crosswise alignment reference member 252 includes an abutment portion 260 for an abutment of an edge in the width direction W of the sheet for the binding process. A height L1 of the abutment portion 260 is configured to be smaller than a height L2 of the recess portion 261 of the stapler 51. That is, the stapler 51 is disposed not to overlap with the movable crosswise alignment reference member 252 when the stapler 51 and the movable crosswise alignment reference member 252 are viewed in the sheet discharge direction CD, and is movable in the sheet discharge direction CD across the movable crosswise alignment reference member 252 by the moving unit 70D. In more particular, when the stapler 51 moves in the sheet discharge direction CD across the movable crosswise alignment reference member 252, the abutment portion 260 passes through an inside of the recess portion 261, and does not interfere with the stapler 51. Further, the fixed crosswise alignment reference member 60*a* and the movable crosswise alignment reference member 252 are similar to each other in shape. Therefore, the stapler 51 is disposed not to overlap with the fixed crosswise alignment reference member 60*a* when the stapler 51 and the fixed crosswise alignment reference member 60*a* are viewed in the sheet discharge direction CD, and is movable in the sheet discharge direction CD across the fixed crosswise alignment reference member 60*a* and the movable crosswise alignment reference member 252.

By configurations as described above, as shown in FIGS. 12A and 12B, in a case where the binding process is performed on an upper left side of the sheet in FIGS. 12A and 12B, it is possible to avoid interference of the stapler 51 with the fixed crosswise alignment reference member 60*a* and the movable crosswise alignment reference member 252. To be noted, the stapler 51 may perform the binding process not only on the upper left side of the sheet but also on a plurality of positions from a lower left side to the upper left side of the sheet in FIGS. 12A and 12B. Further, as described in the third embodiment, it is acceptable to configure the fixed crosswise alignment reference member 60*a* as the movable crosswise alignment reference member 60*b*. Herewith, the alignment of the sheet is improved in a case where the binding process is performed on the upper left side of the sheet of a variety of properties.

Other Embodiments

In the first to the fourth embodiment described above, the postprocessing apparatus 4 of directly coupled to the image forming apparatus 1 has been described as an example of the sheet processing apparatus. However, the present invention is applicable to the sheet processing apparatus which receives the sheet from the image forming apparatus 1 via an intermediate unit (such as a relay conveyance unit furnished in a discharge space of an in-drum delivery type image forming apparatus). Further, the image forming system with the sheet processing apparatus and the image forming apparatus involves a system in which a module having functions of the image forming apparatus 1 and the postprocessing apparatus 4 is mounted in a single casing.

Further, the stapler 51 is an example of the binding unit which performs the binding process to the sheet, and it is acceptable to apply, for example, the needleless binding unit in place of the stapler 51 using staples.

Further, although in the first to the third embodiment, the stapler 51 is coupled to the crosswise alignment reference plate 52 or the movable crosswise alignment reference member 152 by the moving unit 70, it is not limited to this. For example, it is acceptable to fix the stapler 51 directly to the crosswise alignment reference member. Further, although in the second to the fourth embodiment two pieces of crosswise alignment reference members are provided, it is not limited to this, and acceptable to provide equal to or more than three pieces of crosswise alignment reference members.

In the fourth embodiment described above, the stapler 51 is configured to be movable across the fixed crosswise alignment reference member 60*a* and the movable crosswise alignment reference member 252, it is not limited to this. For example, it is acceptable to configure the stapler 51 movable across the movable crosswise alignment reference member 252 but not movable across the fixed crosswise alignment reference member 60*a*. Further, although the movable crosswise alignment reference member 252 stops by the slider 77 abutting against the stopper portion 32*b* provided in the lower part of the intermediate lower guide 32, it is not limited to this. For example, it is acceptable to provide the stopper portion 32*b* in other members than the intermediate lower guide 32, and to configure the slider 77 or the movable crosswise alignment reference member 252 to stop by abutting against the fixed crosswise alignment reference member 60*a* directly. Further, similar to the fourth embodiment, it is acceptable to configure the stapler 51 in the first embodiment movable across the crosswise alignment reference plate.

Further, although, in the first to the fourth embodiment described above, the sheet is configured to be aligned by abutting against the plurality of the longitudinal alignment reference portions 39 and the crosswise alignment reference plate 52 by the alignment mechanism 33, it is not limited to this. For example, it is acceptable to apply a configuration to respectively align the width direction and the sheet conveyance direction of the sheet by a jogger fence and a paddle member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-107294, filed Jun. 7, 2019, and Japanese Patent Application No. 2020-047782, filed Mar. 18, 2020, which are hereby incorporated by reference herein in their entirety.

What is claimed is:

1. A sheet processing apparatus comprising:

a conveyance unit configured to convey a sheet;

a stacking portion on which the sheet conveyed by the conveyance unit is stacked;

a first regulation member configured to regulate a position of an edge portion, in a conveyance direction, of the sheet stacked on the stacking portion;

a second regulation member configured to regulate a position of an edge portion, in a width direction orthogonal to the conveyance direction, of the sheet stacked on the stacking portion;

a binding unit supported movably in the conveyance direction and configured to perform a binding process of binding the sheet stacked on the stacking portion; and a moving unit configured to move the second regulation member in the conveyance direction accompanied with a movement, in the conveyance direction, of the binding unit.

2. The sheet processing apparatus according to claim 1, further comprising a third regulation member disposed at a position different from a position of the second regulation member in the conveyance direction and configured to regulate the position of the edge portion, in the width direction, of the sheet stacked on the stacking portion together with the second regulation member, wherein the third regulation member does not move in a case where the second regulation member is moved by the moving unit.

3. The sheet processing apparatus according to claim 2, wherein a distance between the binding unit and the second regulation member is smaller than a distance between the second regulation member and the third regulation member.

4. The sheet processing apparatus according to claim 1, further comprising a fourth regulation member disposed at a position different from a position of the second regulation member in the conveyance direction and configured to regulate the position of the edge portion of, in the width direction, the sheet stacked on the stacking portion together with the second regulation member, wherein the second regulation member and the fourth regulation member are movable independently each other in the conveyance direction.

5. The sheet processing apparatus according to claim 1, wherein the moving unit comprises a driving source and a belt, the belt being configured to be driven by the driving source and being coupled to the binding unit and the second regulation member.

6. The sheet processing apparatus according to claim 1, wherein the binding unit is disposed not to overlap with the second regulation member when viewed in the conveyance direction and is movable across the second regulation member in the conveyance direction.

7. The sheet processing apparatus according to claim 6, wherein the binding unit comprises a recess portion into which a part of the sheet to be processed with the binding process enters, wherein the second regulation member comprises an abutment portion configured to be abutted with the edge portion, in the width direction, of the sheet to be processed with the binding process, and wherein the abutment portion is configured to pass through the recess portion in a case where the binding unit moves across the second regulation member in the conveyance direction.

8. The sheet processing apparatus according to claim 6, wherein the moving unit comprises a driving source, an urging member configured to urge the second regulation member so as to contact with the binding unit, a stopper portion against which the second regulation member abuts, and a belt configured to be driven by the driving source and coupled to the binding unit, and wherein the binding unit is configured to relatively move in the conveyance direction with respect to the second regulation member in a case where the belt is driven in a state where the second regulation member abuts against the stopper portion.

9. The sheet processing apparatus according to claim 1, further comprising an alignment unit configured to move the sheet stacked on the stacking portion toward the first regulation member and the second regulation member.

10. The sheet processing apparatus according to claim 1, further comprising:

a first conveyance path configured to receive the sheet;

a reverse portion configured to invert the sheet received from the first conveyance path;

a second conveyance path extending below the first conveyance path, and configured to receive the sheet inverted by the reverse portion and guide the sheet toward the stacking portion;

a third conveyance path extending from the stacking portion along the conveyance direction; and a discharge unit disposed on the third conveyance path and configured to discharge the sheet outside of the sheet processing apparatus, wherein the conveyance unit comprises a pair of rotary members disposed on the second conveyance path and configured to discharge the sheet to the stacking portion.

11. An image forming system comprising:

an image forming apparatus configured to form an image on a sheet; and the sheet processing apparatus according to claim 1 configured to receive the sheet from the image forming apparatus.

12. A sheet processing apparatus comprising:

a conveyance unit configured to convey a sheet;

a stacking portion on which the sheet conveyed by the conveyance unit is stacked;

a first regulation member configured to regulate a position of an edge portion, in a conveyance direction, of the sheet stacked on the stacking portion;

a second regulation member configured to regulate a position of an edge portion, in a width direction orthogonal to the conveyance direction, of the sheet stacked on the stacking portion; and a binding unit supported movably in the conveyance direction and configured to perform a binding process of binding the sheet stacked on the stacking portion, wherein the binding unit is disposed not to overlap with the second regulation member when viewed in the conveyance direction.

13. The sheet processing apparatus according to claim 12, further comprising a third regulation member disposed at a position different from a position of the second regulation member in the conveyance direction and configured to regulate the position of the edge portion, in the width direction, of the sheet stacked on the stacking portion together with the second regulation member, wherein the binding unit is disposed not to overlap with the third regulation member when viewed in the conveyance direction.

14. The sheet processing apparatus according to claim 13, further comprising a moving unit configured to move the second regulation member in the conveyance direction accompanied with a movement, in the conveyance direction, of the binding unit, wherein the binding unit is configured to be movable across the second regulation member and the third regulation member in the conveyance direction.

15. The sheet processing apparatus according to claim 14, wherein the third regulation member is configured not to move in a case where the second regulation member is moved by the moving unit.

16. The sheet processing apparatus according to claim 14, wherein the binding unit comprises a recess portion into which a part of the sheet to be processed with the binding process enters, wherein the second regulation member comprises an abutment portion configured to be abutted with the edge portion, in the width direction, of the sheet to be processed with the binding process, and wherein the abutment portion is configured to pass through the recess portion in a case where the binding unit moves across the second regulation member in the conveyance direction.

17. The sheet processing apparatus according to claim 14, wherein the moving unit comprises a driving source, an urging member configured to urge the second regulation member so as to contact with the binding unit, a stopper portion against which the second regulation member abuts, and a belt configured to be driven by the driving source and coupled to the binding unit, and wherein the binding unit is configured to relatively move in the conveyance direction with respect to the second regulation member in a case where the belt is driven in a state where the second regulation member abuts against the stopper portion.

18. The sheet processing apparatus according to claim 12, further comprising an alignment unit configured to move the sheet stacked on the stacking portion toward the first regulation member and the second regulation member.

19. The sheet processing apparatus according to claim 12, further comprising:

a first conveyance path configured to receive the sheet;

a reverse portion configured to invert the sheet received from the first conveyance path;

a second conveyance path extending below the first conveyance path and configured to receive the sheet inverted by the reverse portion and guide the sheet toward the stacking portion;

a third conveyance path extending from the stacking portion along the conveyance direction; and a discharge unit disposed on the third conveyance path and configured to discharge the sheet outside of the sheet processing apparatus, wherein the conveyance unit comprises a pair of rotary members disposed on the second conveyance path and configured to discharge the sheet to the stacking portion.

20. An image forming system comprising:

an image forming apparatus configured to form an image on a sheet; and the sheet processing apparatus according to claim 12 configured to receive the sheet from the image forming apparatus.

* * * * *